US011021840B2

(12) United States Patent
Sze et al.

(10) Patent No.: US 11,021,840 B2
(45) Date of Patent: Jun. 1, 2021

(54) SOFT ABSORBENT SHEETS, STRUCTURING FABRICS FOR MAKING SOFT ABSORBENT SHEETS, AND METHODS OF MAKING SOFT ABSORBENT SHEETS

(71) Applicant: GPCP IP Holdings LLC, Atlanta, GA (US)

(72) Inventors: Daniel Hue Ming Sze, Appleton, WI (US); Xiaolin Fan, Appleton, WI (US); Hung-Liang Chou, Neenah, WI (US); Taiye Philips Oriaran, Appleton, WI (US); Farminder Singh Anand, Painesville, OH (US); Dean Joseph Baumgartner, Bonduel, WI (US); Joseph Henry Miller, Neenah, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 16/401,269

(22) Filed: May 2, 2019

(65) Prior Publication Data

US 2019/0257035 A1 Aug. 22, 2019

Related U.S. Application Data

(62) Division of application No. 15/912,848, filed on Mar. 6, 2018, now Pat. No. 10,329,716, which is a division (Continued)

(51) Int. Cl.

*D21H 27/00* (2006.01)
*B31F 1/07* (2006.01)

(Continued)

(52) U.S. Cl.

CPC ..... *D21H 27/002* (2013.01); *B31F 1/07* (2013.01); *B31F 1/16* (2013.01); *D21F 7/12* (2013.01);

(Continued)

(58) Field of Classification Search

CPC ..... D21H 11/00; D21H 27/002; D21H 27/02; D21F 11/14; D21F 7/12; D21F 11/006; B31F 1/16; B31F 1/07

See application file for complete search history.

(56) References Cited

U.S. PATENT DOCUMENTS 3,905,863 A 9/1975 Ayers
3,974,025 A 8/1976 Ayers (Continued)

FOREIGN PATENT DOCUMENTS

CL 201703129 A1 6/2018
CN 1723318 A 1/2006

(Continued)

OTHER PUBLICATIONS

Office Action (with Translation) dated Apr. 25, 2019, issued in corresponding Eurasian Patent Application No. 201792666.

(Continued)

*Primary Examiner* — Jose A Fortuna
(74) *Attorney, Agent, or Firm* — Laura L. Bozek

(57) ABSTRACT

Soft absorbent sheets, structuring fabrics for producing soft absorbent sheets, and methods of making soft absorbent sheets. The soft absorbent sheets have a plurality of domed regions or projected regions extending from a surface of the sheets, and connecting regions form a network between domed regions. The domed and projected regions include indented bars that extend across the domed and projected regions in a substantially cross machine direction of the (Continued)

absorbent sheets. The absorbent sheets can be formed by structuring fabrics that have long warp yarn knuckles.

16 Claims, 41 Drawing Sheets

Related U.S. Application Data of application No. 15/175,949, filed on Jun. 7, 2016, now Pat. No. 9,963,831.

(60) Provisional application No. 62/172,659, filed on Jun. 8, 2015.

(51) Int. Cl.

| | |
|---|---|
| ***D21H 11/00*** | (2006.01) |
| ***D21F 7/12*** | (2006.01) |
| ***D21F 11/00*** | (2006.01) |
| ***B31F 1/16*** | (2006.01) |
| ***D21F 11/14*** | (2006.01) |

(52) U.S. Cl.

CPC ..... *D21F 11/006* (2013.01); *D21F 11/14* (2013.01); *D21H 11/00* (2013.01)

(56) References Cited

U.S. PATENT DOCUMENTS

| | | | | |
|---|---|---|---|---|
| 4,239,065 | A | 12/1980 | Trokhan | |
| 4,490,925 | A | 1/1985 | Smith | |
| 4,507,173 | A | 3/1985 | Klowak et al. | |
| 5,456,293 | A | 10/1995 | Ostermayer et al. | |
| 6,187,137 | B1 | 2/2001 | Druecke et al. | |
| 7,300,554 | B2 | 11/2007 | Lafond et al. | |
| 7,399,378 | B2 | 7/2008 | Edwards et al. | |
| 7,494,563 | B2 | 2/2009 | Edwards et al. | |
| 7,503,998 | B2 | 3/2009 | Murray et al. | |
| 7,563,344 | B2 | 7/2009 | Beuther et al. | |
| 7,662,255 | B2 | 2/2010 | Murray et al. | |
| 7,918,964 | B2 | 4/2011 | Edwards et al. | |
| 8,080,130 | B2 | 12/2011 | Harper et al. | |
| 8,142,612 | B2 | 3/2012 | Murray et al. | |
| 8,293,072 | B2 | 10/2012 | Super et al. | |
| 8,409,404 | B2 | 4/2013 | Harper et al. | |
| 8,512,516 | B2 | 8/2013 | Murray et al. | |
| 8,871,060 | B2 | 10/2014 | Klerelid | |
| 9,062,416 | B2 | 6/2015 | Sze | |
| 9,303,363 | B2 * | 4/2016 | Chou | D21H 27/005 |
| 9,349,175 | B2 | 5/2016 | Sze | |
| 9,382,663 | B2 * | 7/2016 | Sze | G06T 7/40 |
| 9,388,534 | B2 | 7/2016 | Super et al. | |
| 9,404,224 | B2 | 8/2016 | Chou et al. | |
| 9,443,301 | B2 | 9/2016 | Sze | |
| 9,574,306 | B2 | 2/2017 | Chou et al. | |
| 9,611,591 | B2 | 4/2017 | Chou et al. | |
| 9,702,088 | B2 | 7/2017 | White et al. | |
| 9,879,378 | B2 | 1/2018 | Sze | |
| 9,915,032 | B2 | 3/2018 | Chou et al. | |
| 9,920,479 | B2 * | 3/2018 | Sze | D21F 11/14 |
| 9,920,480 | B2 | 3/2018 | Sze | |
| 9,953,405 | B2 | 4/2018 | Sze | |
| 9,957,667 | B2 | 5/2018 | Chou et al. | |
| 9,963,828 | B2 | 5/2018 | Sze | |
| 9,963,831 | B2 * | 5/2018 | Sze | D21F 7/12 |
| 10,138,601 | B2 * | 11/2018 | Sze | D21F 11/006 |
| 10,329,716 | B2 * | 6/2019 | Sze | D21G 9/0036 |
| 2004/0221914 | A1 | 11/2004 | Martin | |
| 2005/0067039 | A1 | 3/2005 | Lafond et al. | |
| 2008/0029235 | A1 | 2/2008 | Edwards et al. | |
| 2010/0186913 | A1 | 7/2010 | Super et al. | |
| 2013/0068868 | A1 | 3/2013 | Hermans et al. | |
| 2013/0139989 | A1 | 6/2013 | Ryan et al. | |
| 2014/0130996 | A1 | 5/2014 | Sze | |
| 2014/0133734 | A1 | 5/2014 | Sze | |
| 2014/0254885 | A1 * | 9/2014 | Sze | D21F 11/006 382/111 |
| 2015/0129145 | A1 * | 5/2015 | Chou | D04H 1/425 162/116 |
| 2015/0129146 | A1 * | 5/2015 | Chou | D21F 7/12 162/116 |
| 2015/0152603 | A1 | 6/2015 | Super et al. | |
| 2015/0204016 | A1 | 7/2015 | Sze | |
| 2015/0225898 | A1 | 8/2015 | Sze | |
| 2015/0240421 | A1 | 8/2015 | Sze | |
| 2015/0243011 | A1 | 8/2015 | Sze | |
| 2016/0097164 | A1 | 4/2016 | Chou et al. | |
| 2016/0267639 | A1 | 9/2016 | Sze | |
| 2016/0305072 | A1 | 10/2016 | Chou et al. | |
| 2016/0355982 | A1 * | 12/2016 | Sze | D21H 27/002 |
| 2016/0369453 | A1 | 12/2016 | Sze | |
| 2017/0089013 | A1 * | 3/2017 | Sze | D21F 11/006 |
| 2017/0121912 | A1 | 5/2017 | Chou et al. | |
| 2017/0121914 | A1 | 5/2017 | Chou et al. | |
| 2018/0195238 | A1 * | 7/2018 | Sze | D21H 27/002 |
| 2018/0371697 | A1 * | 12/2018 | Sze | D21F 7/12 |
| 2019/0257035 | A1 * | 8/2019 | Sze | B31F 1/16 |

FOREIGN PATENT DOCUMENTS

| | | | |
|---|---|---|---|
| CN | 1942627 | A | 4/2007 |
| CN | 101235612 | A | 8/2008 |
| CN | 101529019 | A | 9/2009 |
| CN | 1969087 | B | 3/2011 |
| CN | 1849423 | B | 9/2011 |
| CN | 102216068 | A | 10/2011 |
| CN | 102578944 | A | 7/2012 |
| CN | 103228299 | A | 7/2013 |
| EP | 3303694 | B1 | 7/2019 |
| JP | S50-025811 | A | 3/1975 |
| JP | S56-031095 | A | 3/1981 |
| JP | 2006-305175 | A | 11/2006 |
| JP | 2010-507734 | A | 3/2010 |
| JP | 2012-516398 | A | 7/2012 |
| WO | 2008027799 | A2 | 3/2008 |
| WO | 2013048992 | A1 | 4/2013 |
| WO | 2015/073863 | A1 | 5/2015 |
| WO | 2016200867 | A1 | 12/2016 |

OTHER PUBLICATIONS

Colombian Official Action dated Oct. 24, 2017, issued in corresponding Colombian Patent Application No. NC2017/0010435, with an English translation.

International Search Report dated Jun. 26, 2017, in corresponding International Patent Application No. PCT/US2017/026509.

International Search Report and Written Opinion dated Aug. 25, 2016, in corresponding International Application No. PCT/US2016/036332.

International Preliminary Report on Patentability and Written Opinion dated Dec. 21, 2017, in corresponding International Application No. PCT/US2016/036332.

Office Action dated Jan. 16, 2019, issued in corresponding Chilean Patent Application No. 201703129.

Office Action dated Oct. 8, 2018, issued in corresponding Chilean Patent Application No. 201703129.

International Preliminary Report on Patentability dated Dec. 20, 2018, issued in corresponding International Patent Application No. PCT/US17/0256509.

Office Action (with Translation) dated Dec. 25, 2019, issued in corresponding Chinese Patent Application No. 201680026649.8.

Decision to Grant dated May 22, 2020, issued in corresponding Russian Patent Application No. 2018146535.

Office Action dated Mar. 24, 2020, issued in corresponding Japanese Patent Application No. 2017-563586.

Office Action dated Jun. 30, 2020, issued in corresponding Argentinian Patent Application No. 20160101704.

Search Report dated Jul. 30, 2020, issued in corresponding Eurasian Patent Application No. 202090207.

(56) References Cited

OTHER PUBLICATIONS

Office Action dated Aug. 3, 2020, issued in corresponding Chilean Patent Application No. 201901058.
Notice of Allowance dated Aug. 24, 2020, issued in corresponding Chinese Patent Application No. 201680026649.8.
Office Action dated Aug. 25, 2020, issued in corresponding Japanese Patent Application No. 2017-563586.
Office Action dated Dec. 22, 2020, issued in corresponding Chinese Patent Application No. 201780034686.8.
Office Action dated Jan. 5, 2021, issued in corresponding Japanese Patent Application No. 2018-563785.

* cited by examiner

| FABRIC | 1 | 2 | 3 |
|---|---|---|---|
| Pressure Imprint Picture | 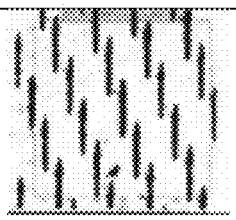 | 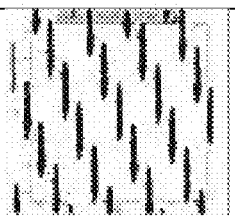 | 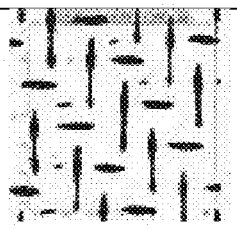 |
| In-plane Warp Contact Length (mm) | 2.74 | 2.67 | 2.95 |
| In-plane Warp Contact Width (mm) | 0.23 | 0.23 | 0.24 |
| Warp Contact Area % | 14.5 | 14.1 | 8.3 |
| In-plane Weft Contact Length (mm) | 0.00 | 0.00 | 1.37 |
| In-plane Weft Contact Width (mm) | 0.00 | 0.00 | 0.33 |
| Weft Contact Area % | 0.0 | 0.0 | 5.1 |
| Total In-Plane Contact Area (%) | 14.5 | 14.1 | 13.5 |
| % Warp of Total In-Plane Contact Area | 100 | 100 | 62 |
| % Weft of Total In-Plane Contact Area | 0 | 0 | 38 |
| Pocket Density | 23.5 | 23.5 | 11.9 |
| Frequency R ($1/cm^2$) | 4.8 | 4.8 | 4.2 |
| Frequency R degrees | 115 | 116 | 144 |
| Frequency B ($1/cm^2$) | 4.9 | 4.9 | 2.8 |
| Frequency B degrees | 199 | 200 | 219 |
| Pocket Depth (microns) | N/C | N/C | N/C |

FIG. 3A

| FABRIC | 4 | 5 | 6 |
|---|---|---|---|
| Pressure Imprint Picture | 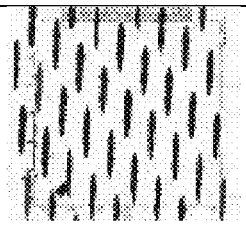 | 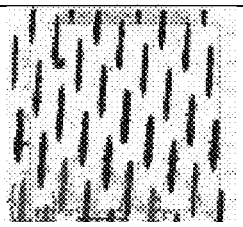 | 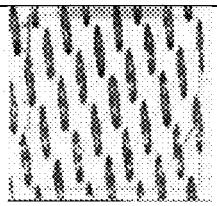 |
| In-plane Warp Contact Length (mm) | 2.11 | 2.44 | 2.67 |
| In-plane Warp Contact Width (mm) | 0.23 | 0.23 | 0.38 |
| Warp Contact Area % | 17.6 | 19.3 | 24.4 |
| In-plane Weft Contact Length (mm) | 0.00 | 0.00 | 0.03 |
| In-plane Weft Contact Width (mm) | 0.00 | 0.00 | 0.03 |
| Weft Contact Area % | 0.0 | 0.0 | 0.0 |
| Total In-Plane Contact Area (%) | 17.6 | 19.3 | 24.4 |
| % Warp of Total In-Plane Contact Area | 100 | 100 | 1.0 |
| % Weft of Total In-Plane Contact Area | 0 | 0 | 0.0 |
| Pocket Density | 37.4 | 35.3 | 30.7 |
| Frequency R ($1/cm^2$) | 7.2 | 7.2 | 5.0 |
| Frequency R degrees | 158 | 158.5 | 147 |
| Frequency B ($1/cm^2$) | 5.2 | 4.9 | 8.1 |
| Frequency B degrees | 227 | 223 | 196 |
| Pocket Depth (microns) | N/C | N/C | 320.0 |

FIG. 3B

| FABRIC | 7 | 8 | 9 |
|---|---|---|---|
| Pressure Imprint Picture | 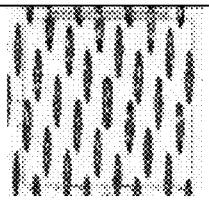 | 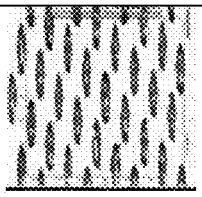 | 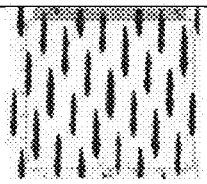 |
| In-plane Warp Contact Length (mm) | 2.67 | 2.67 | 2.39 |
| In-plane Warp Contact Width (mm) | 0.38 | 0.38 | 0.28 |
| Warp Contact Area % | 23.9 | 24.4 | 21.3 |
| In-plane Weft Contact Length (mm) | 0.00 | 0.00 | 0.00 |
| In-plane Weft Contact Width (mm) | 0.00 | 0.00 | 0.00 |
| Weft Contact Area % | 0.0 | 0.0 | 0.0 |
| Total In-Plane Contact Area (%) | 24.0 | 24.5 | 21.3 |
| % Warp of Total In-Plane Contact Area | 1.0 | 1.0 | 100 |
| % Weft of Total In-Plane Contact Area | 0.0 | 0.0 | 0 |
| Pocket Density | 30.1 | 30.8 | 32.8 |
| Frequency R ($1/cm^2$) | 8.0 | 8.1 | 7.0 |
| Frequency R degrees | 168.5 | 169.5 | 163 |
| Frequency B ($1/cm^2$) | 5.0 | 5.0 | 4.7 |
| Frequency B degrees | 218 | 219 | 225 |
| Pocket Depth (microns) | 292.0 | 337.0 | 371.3 |

FIG. 3C

| FABRIC | 10 | 11 | 12 |
|---|---|---|---|
| Pressure Imprint Picture | 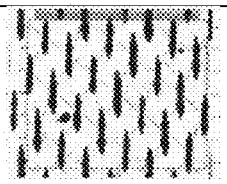 | 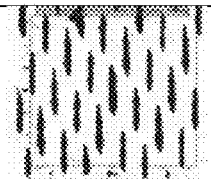 | 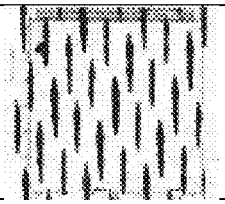 |
| In-plane Warp Contact Length (mm) | 2.34 | 2.36 | 2.44 |
| In-plane Warp Contact Width (mm) | 0.25 | 0.28 | 0.28 |
| Warp Contact Area % | 20.1 | 21.9 | 23.0 |
| In-plane Weft Contact Length (mm) | 0.00 | 0.00 | 0.00 |
| In-plane Weft Contact Width (mm) | 0.00 | 0.00 | 0.00 |
| Weft Contact Area % | 0.0 | 0.0 | 0.0 |
| Total In-Plane Contact Area (%) | 20.1 | 21.9 | 23.0 |
| % Warp of Total In-Plane Contact Area | 100 | 100 | 100 |
| % Weft of Total In-Plane Contact Area | 0 | 0 | 0 |
| Pocket Density | 34.6 | 34.1 | 34.6 |
| Frequency R ($1/cm^2$) | 7.0 | 7.1 | 7.2 |
| Frequency R degrees | 161 | 163 | 162 |
| Frequency B ($1/cm^2$) | 4.9 | 4.8 | 4.8 |
| Frequency B degrees | 226 | 227 | 227 |
| Pocket Depth (microns) | 327.0 | 339.1 | 384.2 |

FIG. 3D

| FABRIC | 13 | 14 | 15 |
|---|---|---|---|
| Pressure Imprint or Picture | 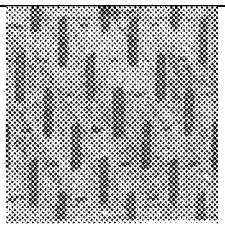 | 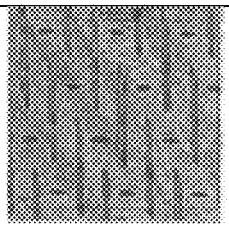 | 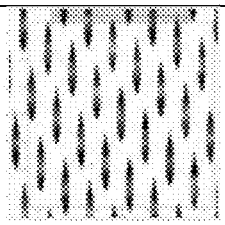 |
| In-plane Warp Contact Length (mm) | 2.26 | 4.67 | 2.41 |
| In-plane Warp Contact Width (mm) | 0.43 | 0.43 | 0.30 |
| Warp Contact Area % | 19.1 | 25.9 | 22.0 |
| In-plane Weft Contact Length (mm) | 0.56 | 0.84 | 0.00 |
| In-plane Weft Contact Width (mm) | 0.20 | 0.20 | 0.00 |
| Weft Contact Area % | 2.1 | 2.1 | 0.0 |
| Total In-Plane Contact Area (%) | 21.2 | 20.8 | 22.0 |
| % Warp of Total In-Plane Contact Area | 90 | 92 | 1.0 |
| % Warp of Total In-Plane Contact Area | 10 | 8 | 0.0 |
| Pocket Density | 20.4 | 13.1 | 30.8 |
| Frequency R ($1/cm^2$) | 5.1 | 4.0 | N/C |
| Frequency R degrees | 129.5 | 141.5 | N/C |
| Frequency B ($1/cm^2$) | 4.0 | 3.6 | N/C |
| Frequency B degrees | 220 | 207 | N/C |
| Pocket Depth | N/C | N/C | 198.3 |

FIG. 3E

| FABRIC | 16 | 17 |
|---|---|---|
| Pressure Imprint Picture | | |
| In-plane Warp Contact Length (mm) | 2.11 | 1.98 |
| In-plane Warp Contact Width (mm) | 0.46 | 0.38 |
| Warp Contact Area % | 26.3 | 22.1 |
| In-plane Weft Contact Length (mm) | 0.00 | 0.00 |
| In-plane Weft Contact Width (mm) | 0.00 | 0.00 |
| Weft Contact Area % | 0.0 | 0.0 |
| Total In-Plane Contact Area (%) | 26.3 | 22.2 |
| % Warp of Total In-Plane Contact Area | 1.0 | 1.0 |
| % Warp of Total In-Plane Contact Area | 0.0 | 0.0 |
| Pocket Density | 31.3 | 30.6 |
| Frequency R ($1/cm^2$) | 6.2 | N/C |
| Frequency R degrees | 130 | N/C |
| Frequency B ($1/cm^2$) | 5.0 | N/C |
| Frequency B degrees | 218 | N/C |
| Pocket Depth | 212.0 | 217.8 |

FIG. 3F

| | Fabric 18 | Fabric 19 | Fabric 20 | Fabric 21 |
|---|---|---|---|---|
| Warp Knuckle Length (mm) | 2.64 | 2.64 | 2.64 | 1.96 |
| Warp Knuckle Width (mm) | 0.36 | 0.36 | 0.36 | 0.48 |
| Warp Knuckle Length / Warp Knuckle Width Ratio | 7.3 | 7.3 | 7.3 | 4.1 |
| Warp Contact Area (%) | 27.8 | 27.3 | 28.1 | 26.3 |
| Pocket Density ($cm^{-2}$) | 30.4 | 29.9 | 30.8 | 31.5 |
| Pocket Depth (microns) | 320 | 292 | 337 | 212 |
| Contact Area Ratio (CAR) | 0.278 | 0.273 | 0.281 | 0.263 |
| Unit Cell Area ($mm^2$) | 3.288 | 3.343 | 3.251 | 3.173 |
| Unit Cell Contact Area ($mm^2$) | 0.913 | 0.913 | 0.913 | 0.836 |
| Effective Cell Area [Unit Cell Area × Unit Cell Contact Area] | 2.38 | 2.43 | 2.34 | 2.34 |
| Effective Cell Volume [Effective Cell Area × Pocket Density] | 0.76 | 0.71 | 0.79 | 0.50 |
| PVI | 21.102 | 19.377 | 21.125 | 13.054 |
| PVDI | 6.418 | 5.796 | 6.806 | 4.114 |
| PVDI-KR | 47.0 | 42.5 | 50.0 | 16.8 |

*FIG. 8*

| Sample | Sheet made from Fabric 18 | Sheet made from Fabric 19 | Sheet made from Fabric 20 | Sheet made from Fabric 21 |
|---|---|---|---|---|
| Picture | 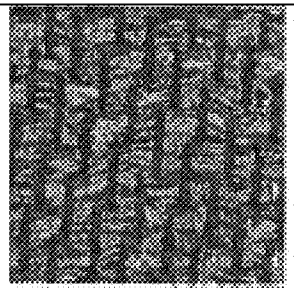 | 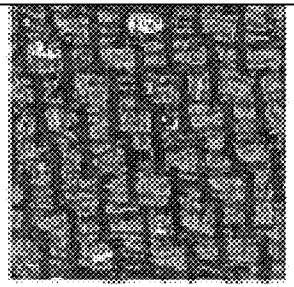 | 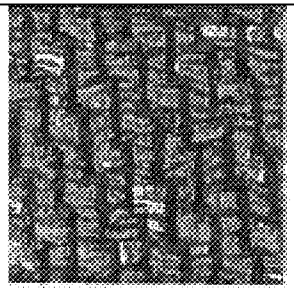 | 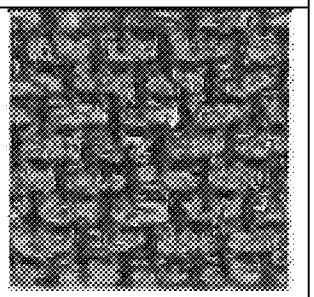 |
| In-plane Warp Contact Length (mm) | 2.4 | 2.4 | 2.5 | 1.5 |
| In-plane Warp Contact width (mm) | 0.3 | 0.3 | 0.2 | 0.3 |
| Warp Contact Area (%) | 21.1 | 20.8 | 20.1 | 16.9 |
| Pocket (Dome) Density | 36 | 36 | 35 | 36 |
| Fabric Cell Frequency R ($1/cm^2$) | 8.3 | 5.2 | 5.2 | 5.3 |
| Fabric Cell Frequency R degrees | 164.5 | 139.5 | 139.5 | 141.5 |
| Fabric Cell Frequency B ($1/cm^2$) | 5.3 | 8.2 | 8.4 | 6.9 |
| Fabric Cell Frequency B degrees | 219 | 195 | 193 | 235 |
FIG. 9

| FABRIC | 22 | 23 | 24 | 25 | 26 |
|---|---|---|---|---|---|
| In-Plane Warp Contact Length (mm) | 4.27 | 2.87 | 3.71 | 5.36 | 5.56 |
| In-Plane Warp Contact Width (mm) | 0.33 | 0.38 | 0.38 | 0.38 | 0.38 |
| Warp Contact Area (%) | 26.3 | 20.1 | 27.0 | 27.1 | 25.4 |
| In-Plane Weft Contact Length (mm) | 0.53 | 0.00 | 0.00 | 0.43 | 0.51 |
| In-Plane Weft Contact Width (mm) | 0.25 | 0.00 | 0.00 | 0.25 | 0.25 |
| Weft Contact Area (%) | 2.3 | 0.0 | 0.0 | 1.3 | 1.4 |
| Total In-Plane Contact Area (%) | 28.6 | 20.2 | 27.0 | 28.4 | 26.8 |
| % Warp of Total In-Plane Contact Area | 92 | 100 | 100 | 95 | 95 |
| % Weft of Total In-Plane Contact Area | 8 | 0 | 0 | 5 | 5 |
| Pocket Density ($cm^{-2}$) | 18.9 | 19.0 | 19.6 | 13.5 | 12.1 |
| Pocket Depth (microns) | 276 | 363 | 385 | 429 | 487 |
| PVI | 29.711 | 30.809 | 38.872 | 64.636 | 78.519 |
| PVDI | 5.631 | 5.841 | 7.602 | 8.721 | 9.539 |
| PVDI-KR | 72.9 | 44.1 | 74.2 | 122.7 | 139.6 |

*FIG. 10A*

| FABRIC | 27 | 28 | 29 | 30 | 31 |
|---|---|---|---|---|---|
| In-Plane Warp Contact Length (mm) | 5.49 | 2.74 | 3.43 | 3.28 | 2.87 |
| In-Plane Warp Contact Width (mm) | 0.38 | 0.38 | 0.28 | 0.33 | 0.36 |
| Warp Contact Area (%) | 26.2 | 26.7 | 24.7 | 26.2 | 26.6 |
| In-Plane Weft Contact Length (mm) | 0.51 | 0.23 | 0.41 | 0.25 | 0.00 |
| In-Plane Weft Contact Length (mm) | 0.25 | 0.15 | 0.23 | 0.13 | 0.00 |
| Weft Contact Area (%) | 1.5 | 0.8 | 2.1 | 0.7 | 0.0 |
| Total In-Plane Contact Area (%) | 27.7 | 27.5 | 26.8 | 26.9 | 26.6 |
| % Warp of Total In-Plane Contact Area | 95 | 97 | 92 | 97 | 100 |
| % Weft of Total In-Plane Contact Area | 5 | 3 | 8 | 3 | 0 |
| Pocket Density ($cm^{-2}$) | 12.7 | 26.3 | 26.2 | 24.8 | 26.7 |
| Pocket Depth (microns) | 503 | 438 | 299 | 294 | 409 |
| PVI | 79.038 | 33.131 | 22.426 | 23.353 | 29.872 |
| PVDI | 10.061 | 8.728 | 5.875 | 5.784 | 7.989 |
| PVDI-KR | 144.9 | 62.9 | 72.0 | 57.5 | 63.7 |

*FIG. 10B*

| FABRIC | 32 | 33 | 34 | 35 | 36 |
|---|---|---|---|---|---|
| In-Plane Warp Contact Length (mm) | 4.29 | 4.50 | 4.95 | 5.61 | 4.50 |
| In-Plane Warp Contact Width (mm) | 0.30 | 0.30 | 0.33 | 0.36 | 0.33 |
| Warp Contact Area (%) | 32.8 | 35.6 | 42.1 | 12.8 | 18.8 |
| In-Plane Weft Contact Length (mm) | 0.00 | 0.00 | 0.00 | 0.00 | 0.00 |
| In-Plane Weft Contact Length (mm) | 0.00 | 0.00 | 0.00 | 0.00 | 0.00 |
| Weft Contact Area (%) | 0.0 | 0.0 | 0.0 | 0.0 | 0.0 |
| Total In-Plane Contact Area (%) | 32.8 | 35.6 | 42.1 | 12.8 | 18.8 |
| % Warp of Total In-Plane Contact Area | 100 | 100 | 100 | 100 | 100 |
| % Weft of Total In-Plane Contact Area | 0 | 0 | 0 | 0 | 0 |
| Pocket Density ($cm^{-2}$) | 25.4 | 26.3 | 26.1 | 6.5 | 12.9 |
| Pocket Depth (microns) | 306 | 335 | 296 | 366 | 428 |
| PVI | 26.493 | 29.191 | 27.627 | 62.925 | 50.754 |
| PVDI | 6.736 | 7.686 | 7.220 | 4.081 | 6.531 |
| PVDI-KR | 96.3 | 115.3 | 108.3 | 63.6 | 89.1 |

FIG. 10C

| FABRIC | 37 | 38 | 39 | 40 | 41 |
|---|---|---|---|---|---|
| In-Plane Warp Contact Length (mm) | 2.21 | 2.44 | 2.26 | 2.49 | 2.41 |
| In-Plane Warp Contact Width (mm) | 0.33 | 0.41 | 0.38 | 0.38 | 0.30 |
| Warp Contact Area (%) | 17.2 | 29.4 | 25.7 | 28.4 | 22.0 |
| In-Plane Weft Contact Length (mm) | 0.00 | 0.00 | 0.00 | 0.00 | 0.00 |
| In-Plane Weft Contact Length (mm) | 0.00 | 0.00 | 0.00 | 0.00 | 0.00 |
| Weft Contact Area (%) | 0.0 | 0.0 | 0.0 | 0.0 | 0.0 |
| Total In-Plane Contact Area (%) | 17.2 | 29.5 | 25.7 | 28.4 | 22.0 |
| % Warp of Total In-Plane Contact Area | 100 | 100 | 100 | 100 | 100 |
| % Weft of Total In-Plane Contact Area | 0 | 0 | 0 | 0 | 0 |
| Pocket Density ($cm^{-2}$) | 24.3 | 30.8 | 30.9 | 30.9 | 30.8 |
| Pocket Depth (microns) | 459 | 337 | 292 | 320 | 164 |
| PVI | 26.887 | 17.267 | 17.343 | 15.772 | 9.137 |
| PVDI | 6.540 | 5.320 | 5.367 | 4.881 | 2.814 |
| PVDI-KR | 43.8 | 31.7 | 31.9 | 32.0 | 22.6 |

FIG. 10D

| FABRIC | 42 | 43 | 44 | 45 |
|---|---|---|---|---|
| Pressure Imprint Picture | | | | |
| In-plane Warp Contact Length (mm) | 4.34 | 5.38 | 2.13 | 1.57 |
| In-plane Warp Contact Width (mm) | 0.43 | 0.30 | 0.41 | 0.36 |
| Warp Contact Area (%) | 26.4 | 28.0 | 22.2 | 20.5 |
| In-plane Weft Contact Length (mm) | 0.0 | 0.0 | 0.0 | 0.0 |
| In-plane Weft Contact Width (mm) | 0.0 | 0.0 | 0.0 | 0.0 |
| Weft Contact Area (%) | 0.0 | 0.0 | 0.0 | 0.0 |
| Total In-plane Contact Area (%) | 26.4 | 28.0 | 22.2 | 19.9 |
| % Warp of Total In-plane Contact Area | 100 | 100 | 100 | 100 |
| % Weft of Total In-plane Contact Area | 0 | 0 | 0 | 0 |
| Pocket Density ($cm^{-2}$) | 14.4 | 17.3 | 26.6 | 37.3 |
| Pocket Depth (microns) | 526 | 401 | 366 | 305 |
| PVI | 71.044 | 46.849 | 23.690 | 13.038 |
| PVDI | 10.218 | 8.096 | 6.313 | 4.860 |
| PVDI-KR | 103 | 143 | 33 | 22 |

FIG. 13

SOFT ABSORBENT SHEETS, STRUCTURING FABRICS FOR MAKING SOFT ABSORBENT SHEETS, AND METHODS OF MAKING SOFT ABSORBENT SHEETS

CROSS REFERENCE TO RELATED APPLICATION

This application is a divisional of U.S. patent application Ser. No. 15/912,848, filed Mar. 6, 2018, now U.S. Pat. No. 9,963,831, issued Jun. 25, 2019. U.S. patent application Ser. No. 15/912,848 is a divisional of U.S. patent application Ser. No. 15/175,949, filed Jun. 7, 2016, now U.S. Pat. No. 9,963,831, issued May 8, 2018, which 2018. U.S. patent application Ser. No. 15/175,949 claims the benefit of priority of U.S. Provisional Patent Application No. 62/172,659, filed Jun. 8, 2015. The foregoing applications are incorporated by reference herein in their entireties.

FIELD OF THE INVENTION

Our invention relates to paper products such as absorbent sheets. Our invention also relates to methods of making paper products such as absorbent sheets, as well as to structuring fabrics for making paper products such as absorbent sheets.

RELATED ART

The use of fabrics is well known in the papermaking industry for imparting structure to paper products. More specifically, it is well known that a shape can be provided to paper products by pressing a malleable web of cellulosic fibers against a fabric and then subsequently drying the web. The resulting paper products are thereby formed with a molded shape corresponding to the surface of the fabric. The resulting paper products also thereby have characteristics resulting from the molded shape, such as a particular caliper and absorbency. As such, a myriad of structuring fabrics has been developed for use in papermaking processes to provide products with different shapes and characteristics. And, fabrics can be woven into a near limitless number of patterns for potential use in papermaking processes.

One important characteristic of many absorbent paper products is softness—consumers want, for example, soft paper towels. Many techniques for increasing the softness of paper products, however, have the effect of reducing other desirable properties of the paper products. For example, calendering basesheets as part of a process for producing paper towels can increase the softness of the resulting paper towels, but calendering also has the effect of reducing the caliper and absorbency of the paper towels. On the other hand, many techniques for improving other important properties of paper products have the effect of reducing the softness of the paper products. For example, wet and dry strength resins can improve the underlying strength of paper products, but wet and dry strength resins also reduce the perceived softness of the products.

For these reasons, it is desirable to make softer paper products, such as absorbent sheets. And, it is desirable to be able to make such softer absorbent sheets through manipulation of a structuring fabric used in the process of making the absorbent sheets.

SUMMARY OF THE INVENTION

According to one aspect, our invention provides an absorbent sheet of cellulosic fibers that has a first side and a second side. The absorbent sheet includes a plurality of domed regions projecting from the first side of the sheet, with each of the domed regions including a plurality of indented bars extending across a respective domed region in a substantially cross machine direction (CD) of the absorbent sheet. Connecting regions form a network interconnecting the domed regions of the absorbent sheet.

According to another aspect, our invention provides an absorbent sheet of cellulosic fibers that has a first side and a second side. The absorbent sheet includes a plurality of domed regions projecting from the first side of the sheet, wherein each domed region is positioned adjacent to another domed region such that a staggered line of domed regions extends substantially along the MD of the absorbent sheet. The absorbent sheet also includes connecting regions forming a network interconnecting the domed regions of the absorbent sheet, wherein each connecting region is substantially continuous with two other connecting regions such that substantially continuous lines of connecting regions extend in a stepped manner along the MD of the absorbent sheet.

According to yet another aspect, our invention provides an absorbent sheet of cellulosic fibers that has a first side and a second side. The absorbent sheet includes a plurality of domed regions projecting from the first side of the sheet, with each of the domed regions extending a distance of at least about 2.5 mm in the MD of the absorbent sheet. Each of the plurality of domed regions includes an indented bar extending across a respective domed region in a substantially CD of the absorbent sheet, with the indented bar extending a depth of at least about 45 microns below the adjacent portions of the domed region. Further, connecting regions form a network interconnecting the domed regions of the absorbent sheet.

According to still another aspect, our invention provides a method of making a paper product. The method includes forming an aqueous cellulosic web on a structuring fabric in a papermaking machine, with the structuring fabric including knuckles formed on warp yarns of the structuring fabric, and with the knuckles having a length in the MD of the absorbent sheet and a width in the CD of the absorbent sheet. A planar volumetric density index of the structuring fabric multiplied by the ratio of the length of the knuckles and the width of the knuckles width is about 43 to about 50. The method further includes steps of dewatering the cellulosic web on the structuring fabric, and subsequently drying the cellulosic web to form the absorbent sheet.

According to a further aspect, our invention provides an absorbent cellulosic sheet that has a first side and a second side, with the absorbent sheet including projected regions extending from the first side of the sheet. The projected regions extend substantially in the MD of the absorbent sheet, with each of the projected regions including a plurality of indented bars extending across the projected regions in a substantially CD of the absorbent sheet, and with the projected regions being substantially parallel to each other. Connecting regions are formed between the projected regions, with the connecting regions extending substantially in the MD.

According to yet another aspect, our invention provides a method of making a fabric-creped absorbent cellulosic sheet. The method includes compactively dewatering a papermaking furnish to form a web having a consistency of about 30 percent to about 60 percent. The web is creped under pressure in a creping nip between a transfer surface and a structuring fabric. The structuring fabric includes knuckles formed on warp yarns of the structuring fabric, with the knuckles having a length in the machine direction (MD) of the absorbent sheet and a width in the cross machine direction (CD) of the absorbent sheet. A planar volumetric density index of the structuring fabric multiplied by the ratio of the length of the knuckles and the width of the knuckles width is at least about 43. The method also includes drying the web to form the absorbent cellulosic sheet.

According to one further aspect, our invention provides a method of making a fabric-creped absorbent cellulosic sheet. The method includes compactively dewatering a papermaking furnish to form a web. The web is creped under pressure in a nip between a transfer surface and a structuring fabric. The structuring fabric has machine direction (MD) yarns that form (i) knuckles extending in substantially MD lines along the structuring fabric, and (ii) substantially continuous lines of pockets extending in substantially MD lines along the structuring fabric between the lines of knuckles. The structuring fabric also has cross machine direction (CD) yarns that are completely located below a plane defined by the knuckles of the MD yarns. The method also includes drying the web to form the absorbent cellulosic sheet.

According to yet another aspect, our invention provides a method of making a fabric-creped absorbent cellulosic sheet. The method includes compactively dewatering a papermaking furnish to form a web having a consistency of about 30 percent to about 60 percent. The method further includes creping the web under pressure in a creping nip between a transfer surface and a structuring fabric and drying the web to form the absorbent cellulosic sheet. The absorbent sheet has SAT capacities of at least about 9.5 g/g and at least about 500 g/m2. Further, a creping ratio is defined by the speed of the transfer surface relative to the speed of the structuring fabric, and the creping ratio is less than about 25%.

BRIEF DESCRIPTION OF THE DRAWINGS

FIGS. 3A-3F indicate characteristics of structuring fabrics according to embodiments of our invention and characteristics of comparison structuring fabrics.

FIG. 8 indicates characteristics of structuring fabrics according to embodiments of our invention and a comparison structuring fabric.

FIG. 9 shows the characteristics of basesheets that were made using the structuring fabrics characterized in FIG. 8.

FIGS. 10A-10D indicate characteristics of still further structuring fabrics according to embodiments of our invention.

FIG. 13 indicates characteristics of structuring fabrics according to embodiments of our invention and a comparison structuring fabric.

DETAILED DESCRIPTION OF THE INVENTION

Figure 1:
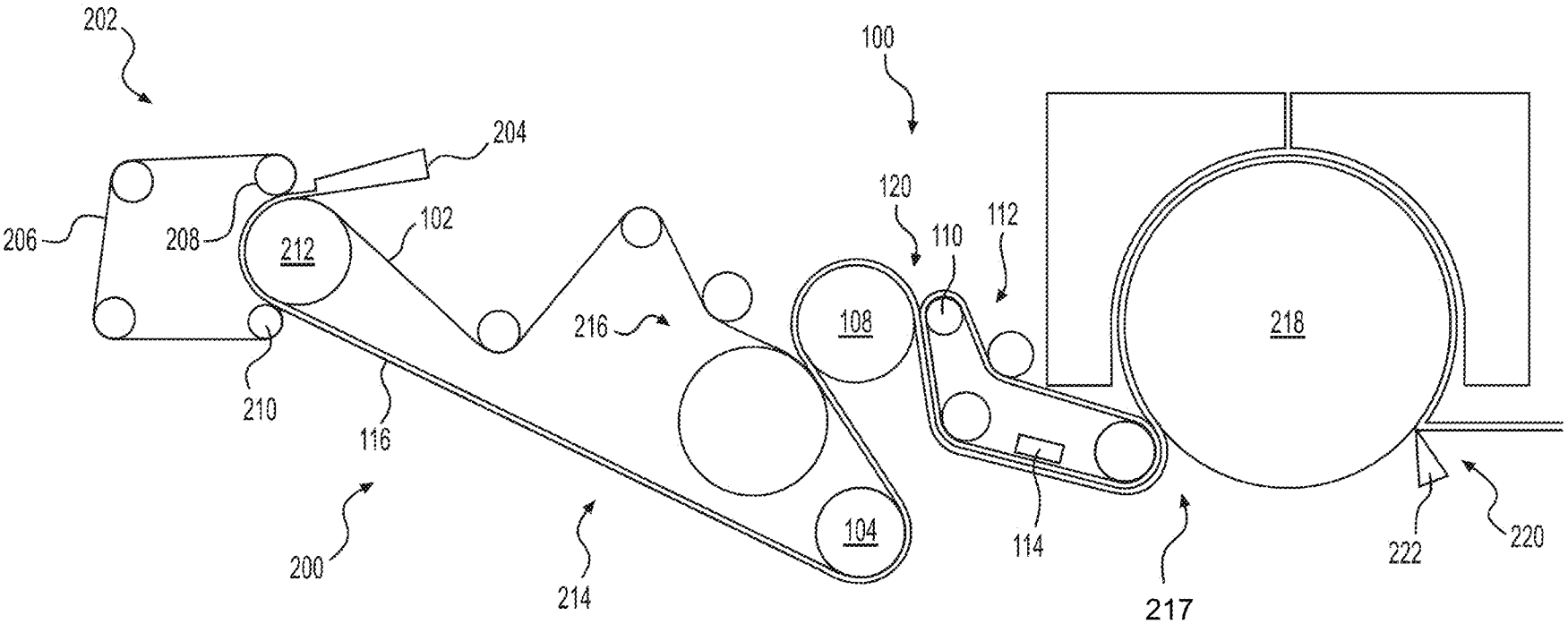
FIG. 1 is a schematic diagram of a papermaking machine configuration that can be used in conjunction with our invention.

Our invention relates to paper products such as absorbent sheets and methods of making paper products such as absorbent sheets. Absorbent paper products according to our invention have outstanding combinations of properties that are superior to other absorbent paper products that are known in the art. In some specific embodiments, the absorbent paper products according to our invention have combinations of properties particularly well suited for absorbent hand towels, facial tissues, or toilet paper.

The term "paper product," as used herein, encompasses any product incorporating papermaking fibers having cellulose as a major constituent. This would include, for example, products marketed as paper towels, toilet paper, facial tissue, etc. Papermaking fibers include virgin pulps or recycled (secondary) cellulosic fibers, or fiber mixes comprising cellulosic fibers. Wood fibers include, for example, those obtained from deciduous and coniferous trees, including softwood fibers, such as northern and southern softwood kraft fibers, and hardwood fibers, such as eucalyptus, maple, birch, aspen, or the like. Examples of fibers suitable for making the products of our invention include non-wood fibers, such as cotton fibers or cotton derivatives, abaca, kenaf, sabai grass, flax, esparto grass, straw, jute hemp, bagasse, milkweed floss fibers, and pineapple leaf fibers.

"Furnishes" and like terminology refers to aqueous compositions including papermaking fibers, and, optionally, wet strength resins, debonders, and the like, for making paper products. A variety of furnishes can be used in embodiments of our invention, and specific furnishes are disclosed in the examples discussed below. In some embodiments, furnishes are used according to the specifications described in U.S. Pat. No. 8,080,130 (the disclosure of which is incorporated by reference in its entirety). The furnishes in this patent include, among other things, cellulosic long fibers having a coarseness of at least about 15.5 mg/100 mm. Examples of furnishes are also specified in the examples discussed below.

As used herein, the initial fiber and liquid mixture that is dried to a finished product in a papermaking process will be referred to as a "web" and/or a "nascent web." The dried, single-ply product from a papermaking process will be referred to as a "basesheet." Further, the product of a papermaking process may be referred to as an "absorbent sheet." In this regard, an absorbent sheet may be the same as a single basesheet. Alternatively, an absorbent sheet may include a plurality of basesheets, as in a multi-ply structure. Further, an absorbent sheet may have undergone additional processing after being dried in the initial basesheet forming process in order to form a final paper product from a converted basesheet. An "absorbent sheet" includes commercial products marketed as, for example, hand towels.

When describing our invention herein, the terms "machine direction" (MD) and "cross machine direction" (CD) will be used in accordance with their well-understood meaning in the art. That is, the MD of a fabric or other structure refers to the direction that the structure moves on a papermaking machine in a papermaking process, while CD refers to a direction crossing the MD of the structure. Similarly, when referencing paper products, the MD of the paper product refers to the direction on the product that the product moved on the papermaking machine in the papermaking process, and the CD of the product refers to the direction crossing the MD of the product.

FIG. 1 shows an example of a papermaking machine 200 that can be used to make paper products according to our invention. A detailed description of the configuration and operation of papermaking machine 200 can be found in U.S. Pat. No. 7,494,563 ("the '563 patent"), the disclosure of which is incorporated by reference in its entirety. Notably, the '563 patent describes a papermaking process that does not use through air drying (TAD).

The following is a brief summary of a process for forming an absorbent sheet using papermaking machine 200.

The papermaking machine 200 is a three-fabric loop machine that includes a press section 100 in which a creping operation is conducted. Upstream of the press section 100 is a forming section 202. The forming section 202 includes headbox 204 that deposits an aqueous furnish on a forming wire 206 supported by rolls 208 and 210, thereby forming an initial aqueous cellulosic web 116. The forming section 202 also includes a forming roll 212 that supports a papermaking felt 102 such that web 116 is also formed directly on the felt 102. The felt run 214 extends about a suction turning roll 104 and then to a shoe press section 216 wherein the web 116 is deposited on a backing roll 108. The web 116 is wet-pressed concurrently with the transfer to the backing roll 108, which carries the web 116 to a creping nip 120. In other embodiments, however, instead of being transferred on the backing roll 108, the web 116 by be transferred from the felt run 214 onto an endless belt in a dewatering nip, with the endless belt then carrying the web 116 to the creping nip 120. An example of such a configuration can be seen in U.S. Pat. No. 8,871,060, which is incorporated by reference herein in its entirety.

The web 116 is transferred onto the structuring fabric 112 in the creping nip 120, and then vacuum drawn by vacuum molding box 114. After this creping operation, the web 116 is deposited on Yankee dryer 218 in another press nip 217 using a creping adhesive. The web 116 is dried on Yankee dryer 218, which is a heated cylinder, and the web 116 is also dried by high jet velocity impingement air in the Yankee hood around the Yankee dryer 218. As the Yankee dryer 218 rotates, the web 116 is peeled from the dryer 218 at position 220. The web 116 may then be subsequently wound on a take-up reel (not shown). The reel may be operated slower than the Yankee dryer 218 at steady-state in order to impart a further crepe to the web. Optionally, a creping doctor blade 222 may be used to conventionally dry-crepe the web 116 as it is removed from the Yankee dryer 218.

In a creping nip 120, the web 116 is transferred onto the top side of the structuring fabric 112. The creping nip 120 is defined between the backing roll 108 and the structuring fabric 112, with the structuring fabric 112 being pressed against the backing roll 108 by the creping roll 110. Because the web still has a high moisture content when it is transferred to the structuring fabric 112, the web is deformable such that portions of the web can be drawn into pockets formed between the yarns that make up the structuring fabric 112. (The pockets of structuring fabrics will be described in detail below.) In particular papermaking processes, the structuring fabric 112 moves more slowly than the papermaking felt 102. Thus, the web 116 is creped as it is transferred onto the structuring fabric 112.

An applied suction from vacuum molding box 114 may also aid in drawing the web 116 into pockets in the surface of the structuring fabric 112, as will be described below. When traveling along the structuring fabric 112, the web 116 reaches a highly consistent state with most of the moisture having been removed. The web 116 is thereby more or less permanently imparted with a shape by the structuring fabric 112, with the shape including domed regions where the web 116 is drawn into the pockets of the structuring fabric 112.

Basesheets made with papermaking machine 200 may also be subjected to further processing, as is known in the art, in order to convert the basesheets into specific products. For example, the basesheets may be embossed, and two basesheets can be combined into multi-ply products. The specifics of such converting processes are well known in the art.

Using the process described in the aforementioned '563 patent, the web 116 is dewatered to the point that it has a higher consistency when transferred onto the top side of the structuring fabric 112 compared to an analogous operation in other papermaking processes, such as a TAD process. That is, the web 116 is compactively dewatered so as to have from about 30 percent to about 60 percent consistency (i.e., solids content) before entering the creping nip 120. In the creping nip 120, the web is subjected to a load of about 30 PLI to about 200 PLI. Further, there is a speed differential between the backing roll 108 and the structuring fabric 112. This speed differential is referred to as the fabric creping percentage, and may be calculated as:

$$\text{Fabric Crepe } \% = S1/S2 - 1$$

where S1 is the speed of the backing roll 108 and S2 is the speed of the structuring fabric 112. In particular embodiments, the fabric crepe percentage can be anywhere from about 3% to about 100%. This combination of web consistency, velocity delta occurring at the creping nip, the pressure employed at the creping nip 120, and the structuring fabric 112 and nip 120 geometry act to rearrange the cellulose fibers while the web 116 is still pliable enough to undergo structural change. In particular, without intending to be bound by theory, it is believed that the slower forming surface speed of the structuring fabric 112 causes the web 116 to be substantially molded into openings in the structuring fabric 116, with the fibers being realigned in proportion to the creping ratio.

While a specific process has been described in conjunction with the papermaking machine 200, those skilled in the art will appreciate that our invention disclosed herein is not limited to the above-described papermaking process. For example, as opposed to the non-TAD process described above, our invention could be related to a TAD papermaking process. An example of a TAD papermaking process can be seen in U.S. Pat. No. 8,080,130, the disclosure of which is incorporated by reference in its entirety.

Figure 2:
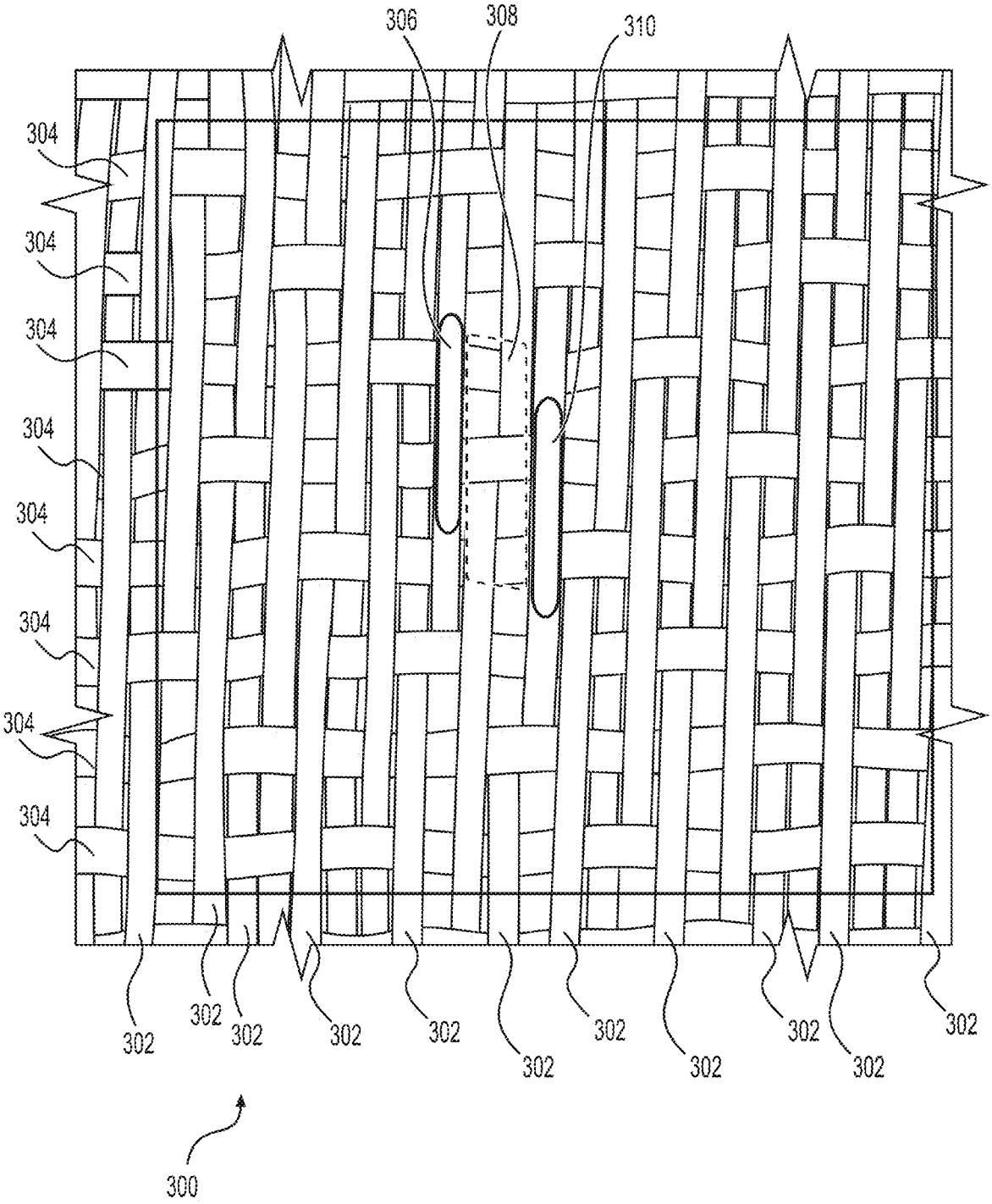
FIG. 2 is a top view of a structuring fabric for making paper products according to an embodiment our invention.

FIG. 2 is a drawing showing details of a portion of the web contacting side of the structuring fabric 300 that has a configuration for forming paper products according to an embodiment of our invention. The fabric 300 includes warp yarns 302 that run in the machine direction (MD) when the fabric is used in a papermaking process, and weft yarns 304 that run in the cross machine direction (CD). The warp and weft yarns 302 and 304 are woven together so as to form the body of the structuring fabric 300. The web-contacting surface of the structuring fabric 300 is formed by knuckles (two of which are outlined in FIG. 2 and labeled as 306 and 310), which are formed on the warp yarns 302, but no knuckles are formed on the weft yarns 304. It should be noted, however, that while the structuring fabric 300 shown in FIG. 2 only has knuckles on the warp yarns 302, our invention is not limited to structuring fabrics that only have warp knuckles, but rather, includes fabrics that have both warp and weft knuckles. Indeed, fabrics with only warp knuckles and fabrics with both warp and weft knuckles will be described in detail below.

The knuckles 306 and 310 in fabric 300 are in a plane that makes up the surface that the web 116 contacts during a papermaking operation. Pockets 308 (one of which is shown as the outlined area in FIG. 2) are defined in the areas between the knuckles 306 and 310. Portions of the web 116 that do not contact the knuckles 306 and 310 are drawn into the pockets 308 as described above. It is the portions of the web 116 that are drawn into the pockets 308 that result in domed regions that are found in the resulting paper products.

Those skilled in the art will appreciate the significant length of warp yarn knuckles 306 and 310 in the MD of structuring fabric 300, and will further appreciate that the fabric 300 is configured such that the long warp yarn knuckles 306 and 310 delineate long pockets in the MD. In particular embodiments of our invention, the warp yarn knuckles 306 and 310 have a length of about 2 mm to about 6 mm. Most structuring fabrics known in the art have shorter warp yarn knuckles (if the fabrics have any warp yarn knuckles at all). As will be described below, the longer warp yarn knuckles 306 and 310 provide for a larger contact area for the web 116 during the papermaking process, and, it is believed, might be at least partially responsible for the increased softness seen in absorbent sheets according to our invention, as compared to absorbent sheets with conventional, shorter warp yarn knuckles.

To quantify the parameters of the structuring fabrics described herein, the fabric characterization techniques described in U.S. Patent Application Publication Nos. 2014/0133734; 2014/0130996; 2014/0254885, and 2015/0129145 (hereafter referred to as the "fabric characterization publications") can be used. The disclosures of the fabric characterization publications are incorporated by reference in their entirety. Such fabric characterization techniques allow for parameters of a structuring fabric to be easily quantified, including knuckle lengths and widths, knuckle densities, pocket areas, pocket densities, pocket depths, and pocket volumes.

FIGS. 3A-3E indicate some of the characteristics of structuring fabrics made according to embodiments of our invention, which are labeled as Fabrics 1-15. FIG. 3F also shows characteristics of conventional structuring fabrics, which are labeled as Fabrics 16 and 17. Structuring fabrics of the type shown in FIGS. 3A-3F can be made by a numerous manufacturers, including Albany International of Rochester, N.H. and Voith GmbH of Heidenheim, Germany. Fabrics 1-15 have long warp yarn knuckle fabrics such that the vast majority of the contact area in Fabrics 1-15 comes from the warp yarn knuckles, as opposed to weft yarn knuckles (if the fabrics have any weft yarn knuckles at all). Fabrics 16 and 17, which have shorter warp yarn knuckles, are provided for comparison. All of the characteristics shown in FIGS. 3A-3F were determined using the techniques in the aforementioned fabric characterization publications, particularly, using the non-rectangular, parallelogram calculation methods that are set forth in the fabric characterization publications. Note that the indications of "N/C" in FIGS. 3A-3F mean that the particular characteristics were not determined.

The air permeability of a structuring fabric is another characteristic that can influence the properties of paper products made with the structuring fabric. The air permeability of a structuring fabric is measured according to well-known equipment and tests in the art, such as Frazier® Differential Pressure Air Permeability Measuring Instruments by Frazier Precision Instrument Company of Hagerstown, Md. Generally speaking, the long warp knuckle structuring fabrics used to produce paper products according to our invention have a high amount of air permeability. In a particular embodiment of our invention, the long warp knuckle structuring fabric has an air permeability of about 450 CFM to about 1000 CFM.

FIGS. 4A-4E are photographs of absorbent sheets made with long warp knuckle structuring fabrics, such as those characterized in FIGS. 3A-3E. More specifically, FIGS. 4A-4E show the air side of the absorbent sheets, that is, the side of the absorbent sheets that contacted the structuring fabric during the process of forming the absorbent sheets. Thus, the distinct shapes that are imparted to the absorbent sheets through contact with the structuring fabrics, including domed regions projecting from the shown side of the absorbent sheet, can be seen in FIGS. 4A-4E. Note that the MD of the absorbent sheets is shown vertically in these figures.

Figure 4A:
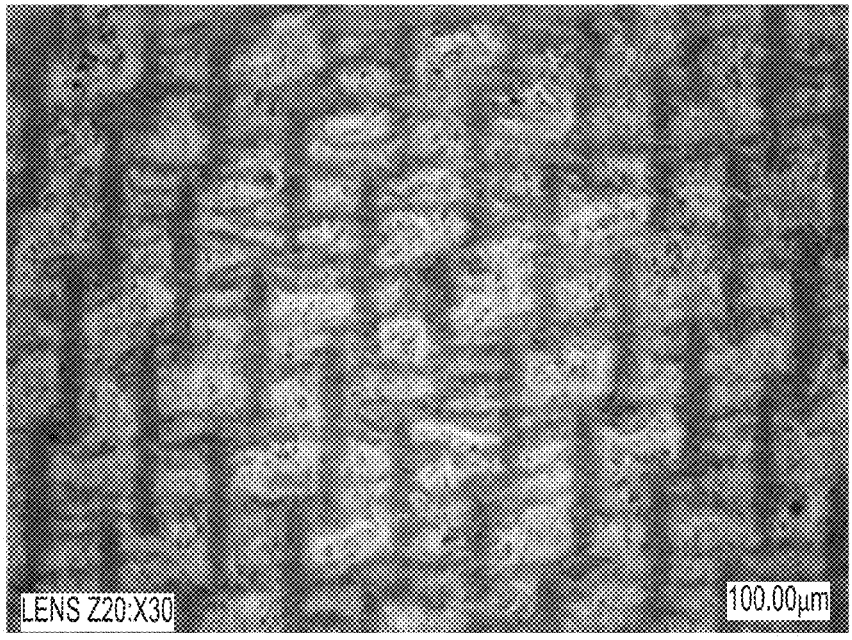
FIGS. 4A-4E are photographs of absorbent sheets according to embodiments of our invention.
Figure 4B:
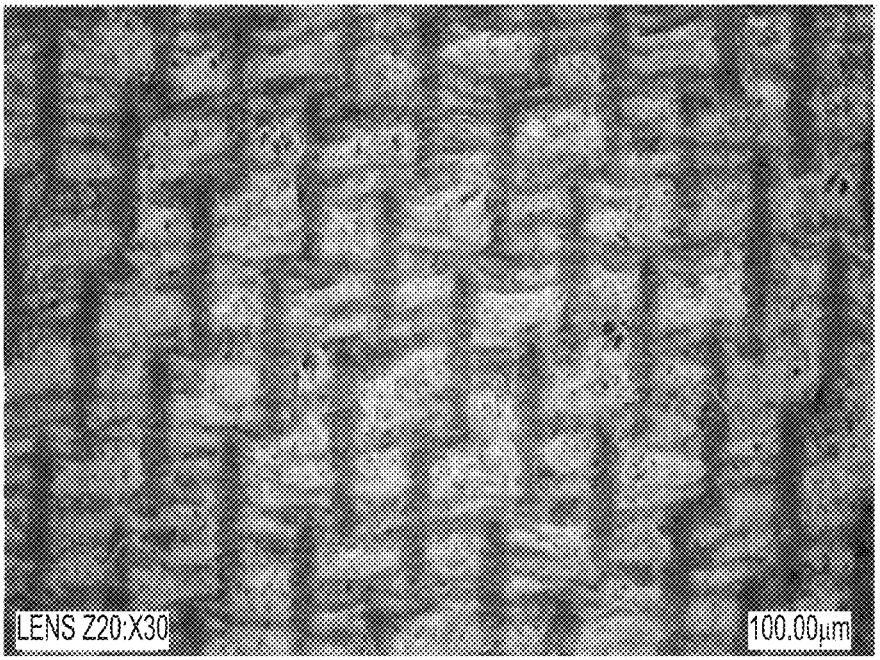
Figure 4C:
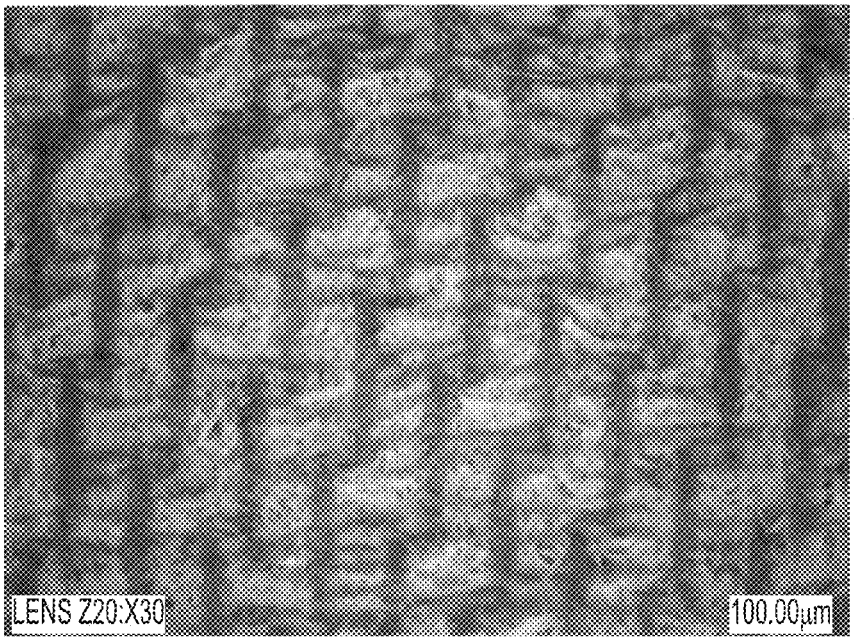
Figure 4D:
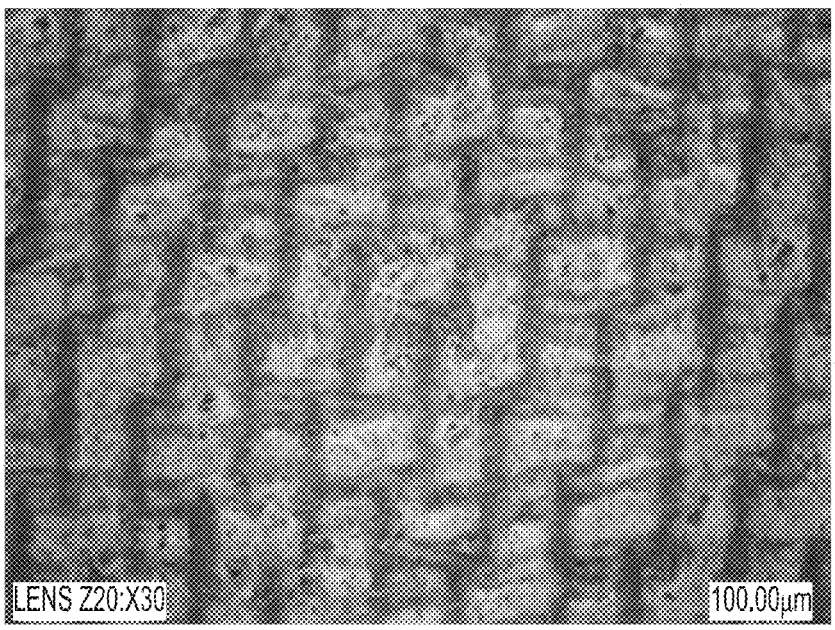
Figure 4E:
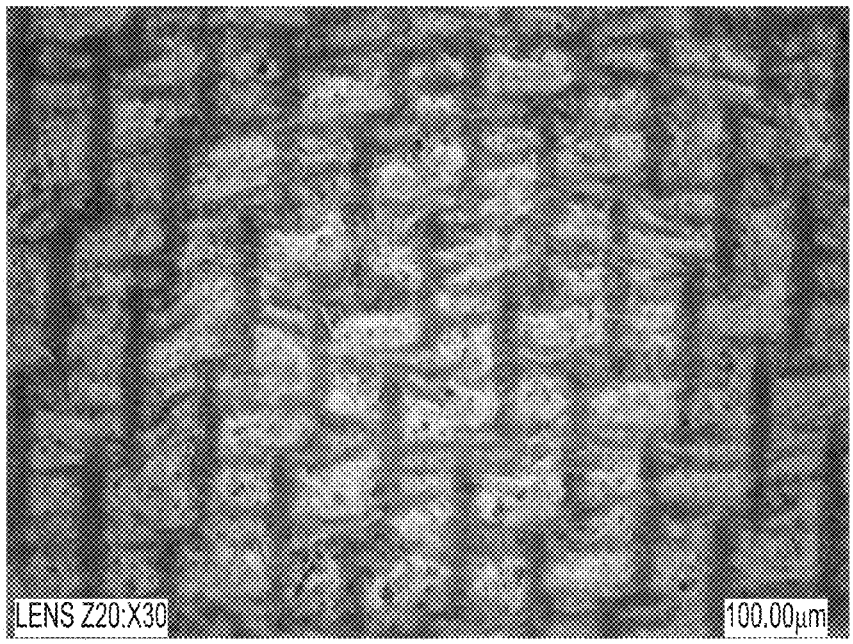
Figure 5:
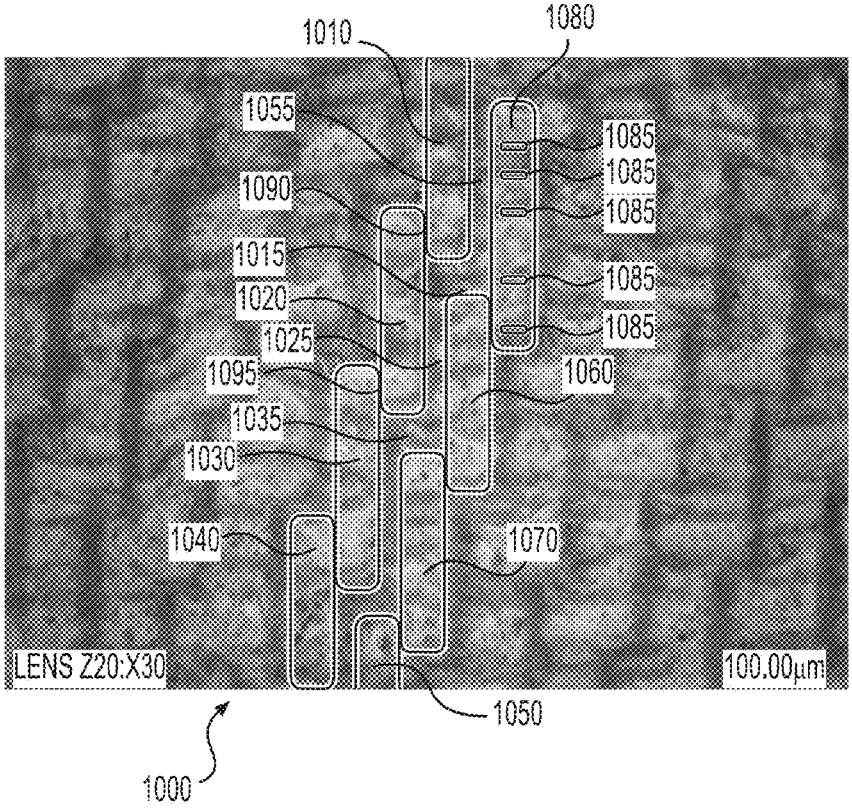
FIG. 5 is an annotated version of the photograph shown in FIG. 4E.

Specific features of the absorbent sheet 1000 are annotated in FIG. 5, which is the photograph shown as FIG. 4E. The absorbent sheet 1000 includes a plurality of substantially rectangular-shaped domed regions, some of which are outlined and labeled 1010, 1020, 1030, 1040, 1050, 1060, 1070, and 1080 in FIG. 5. As explained above, the domed regions 1010, 1020, 1030, 1040, 1050, 1060, 1070, and 1080 correspond to the portions of the web that were drawn into the pockets of the structuring fabric during the process of forming the absorbent sheet 1000. Connecting regions, some of which are labeled 1015, 1025, and 1035 in FIG. 5, form a network interconnecting the domed regions. The connecting regions generally correspond to portions of the web that were formed in the plane of the knuckles of the structuring fabric during the process of forming the absorbent sheet 1000.

Those skilled in the art will immediately recognize several features of the absorbent sheets shown in FIGS. 4A-4E and 5 that are different than conventional absorbent sheets. For instance, all of the domed regions include a plurality of indented bars formed into the tops of the domed regions, with the indented bars extending across the domed regions in the CD of the absorbent sheets. Some of these indented bars are outlined and labeled 1085 in FIG. 5. Notably, almost all of the domed regions have three such indented bars, with some of the domed regions having four, five, six, seven, or even eight indented bars. The number of indented bars can be confirmed using laser scan profiling (described below). Using such laser scan profiling, it was found that in a particular absorbent sheet according to an embodiment of our invention, there are, on average (mean), about six indented bars per domed region.

Without being limited by theory, we believe that the indented bars seen in the absorbent sheets shown in FIGS. 4A-4E and 5 are formed when the web is transferred onto a structuring fabric with the configurations described herein during a papermaking process as described herein. Specifically, when a speed differential is used for creping the web as it is transferred onto the structuring fabric, the web "plows" onto the knuckles of the structuring fabric and into the pockets between the knuckles. As a result, folds are created in the structure of the web, particularly in the areas of the web that are moved into the pockets of the structuring fabric. An indented bar is thus formed between two of such folds in the web. Because of the long MD pockets in the long warp yarn knuckle structuring fabrics described herein, the plowing/folding effect takes place multiple times over a portion of a web that spans a pocket in the structuring fabric. Thus, multiple indented bars are formed in each of the domed regions of absorbent sheets made with the long warp knuckle structuring fabrics described herein.

Figure 6A:
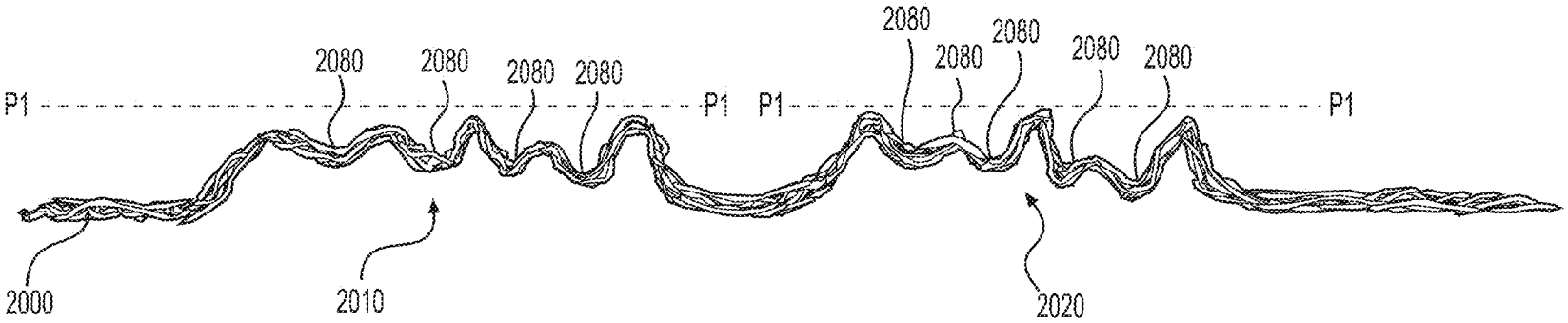
FIGS. 6A and 6B are cross-sectional views of a portion of an absorbent sheet according to an embodiment of our invention and a portion of a comparison absorbent sheet, respectively.
Figure 6B:
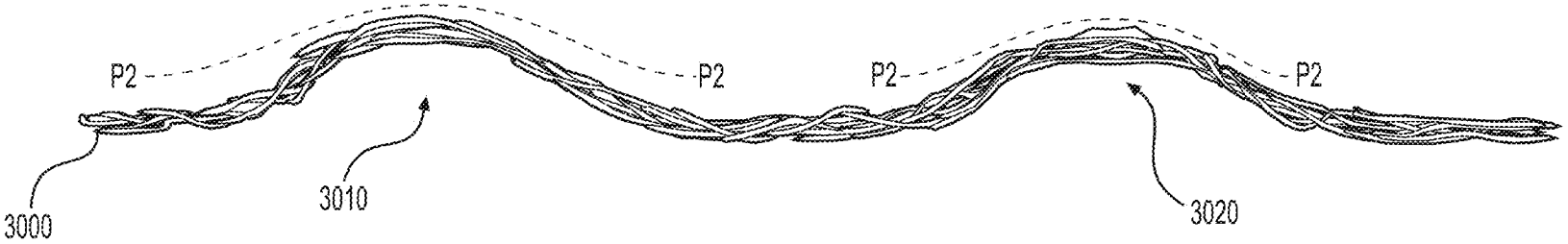

Again, without being limited by theory, we believe that the indented bars in the domed regions may contribute to an increased softness that is perceived in the absorbent sheets according to our invention. Specifically, the indented bars provide a more smooth, flat plane being perceived when the absorbent sheet is touched, as compared to absorbent sheets having conventional domed regions. The difference in perceptional planes is illustrated in FIGS. 6A and 6B, which are drawings showing cross sections of an absorbent sheet 2000 according to our invention and a comparison sheet 3000, respectively. In absorbent sheet 2000, the domed regions 2010 and 2020 include indented bars 2080, with ridges being formed between the indented bars 2080 (the ridges/indents correspond to the folds in the web during the papermaking process as described above). As a result of the small indented bars 2080 and plurality of ridges around the indented bars 2080, flat, smooth perceived planes P1 (marked with dotted lines in FIG. 6A) are formed. These flat, smooth planes P1 are sensed when the absorbent sheet 2000 is touched. We further believe that the users cannot detect the small discontinuities of the indented bars 2080 in the surfaces of the domed regions 2010 and 2020, nor can users detect the short distance between the domed regions 2010 and 2020. Thus, the absorbent sheet 2000 is perceived as having a smooth, soft surface. On the other hand, the perceived planes P2 have a more rounded shape with the conventional domes 3010 and 3020 in comparison sheet 3000, as shown in FIG. 6B, and the conventional domes 3010 and 3020 are spaced apart. It is believed that because the perceived planes P2 of the conventional domes 3010 and 3020 are spaced a significant distance from each other, the comparison sheet 3000 is perceived as less smooth and soft compared to the perceived planes P1 found in the domed regions 2010 and 2020 with the indented bars 2080.

Those skilled in the art will appreciate that, due to the nature of a papermaking process, not every domed region in an absorbent sheet will be identical. Indeed, as noted above, domed regions of an absorbent sheet according to our invention might have different numbers of indented bars. At the same time, a few of the domed regions observed in any particular absorbent sheet of our invention might not include any indented bars. This will not affect the overall properties of the absorbent sheet, however, as long as a majority of the domed regions includes the indented bars. Thus, when we refer to an absorbent sheet as having domed regions that include a plurality of indented bars, it will be understood that that absorbent sheet might have a few domed regions with no indented bars.

Figure 7A:
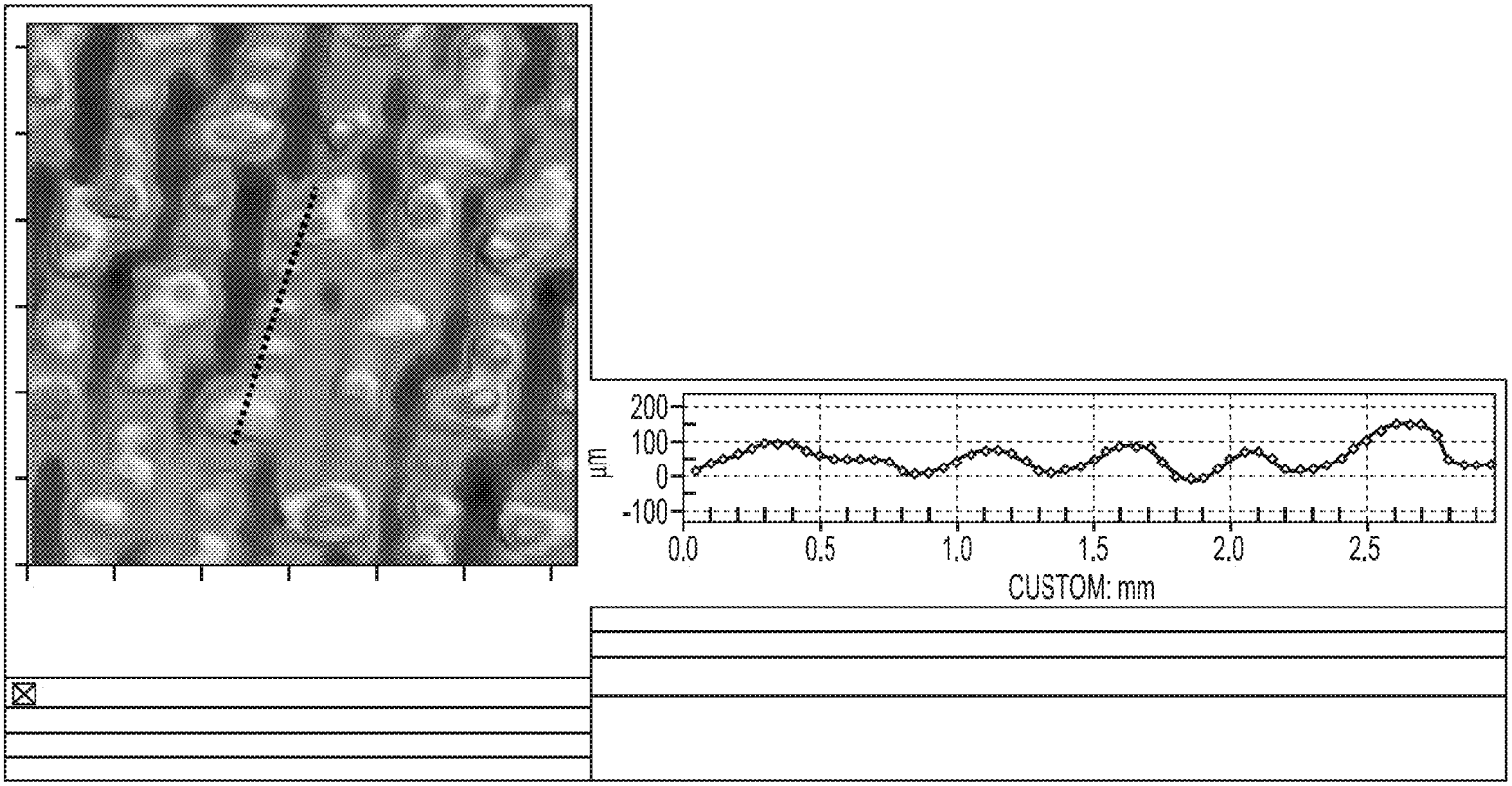
FIGS. 7A and 7B show laser scans for determining the profile of portions of absorbent sheets according to embodiments of our invention.
Figure 7B:
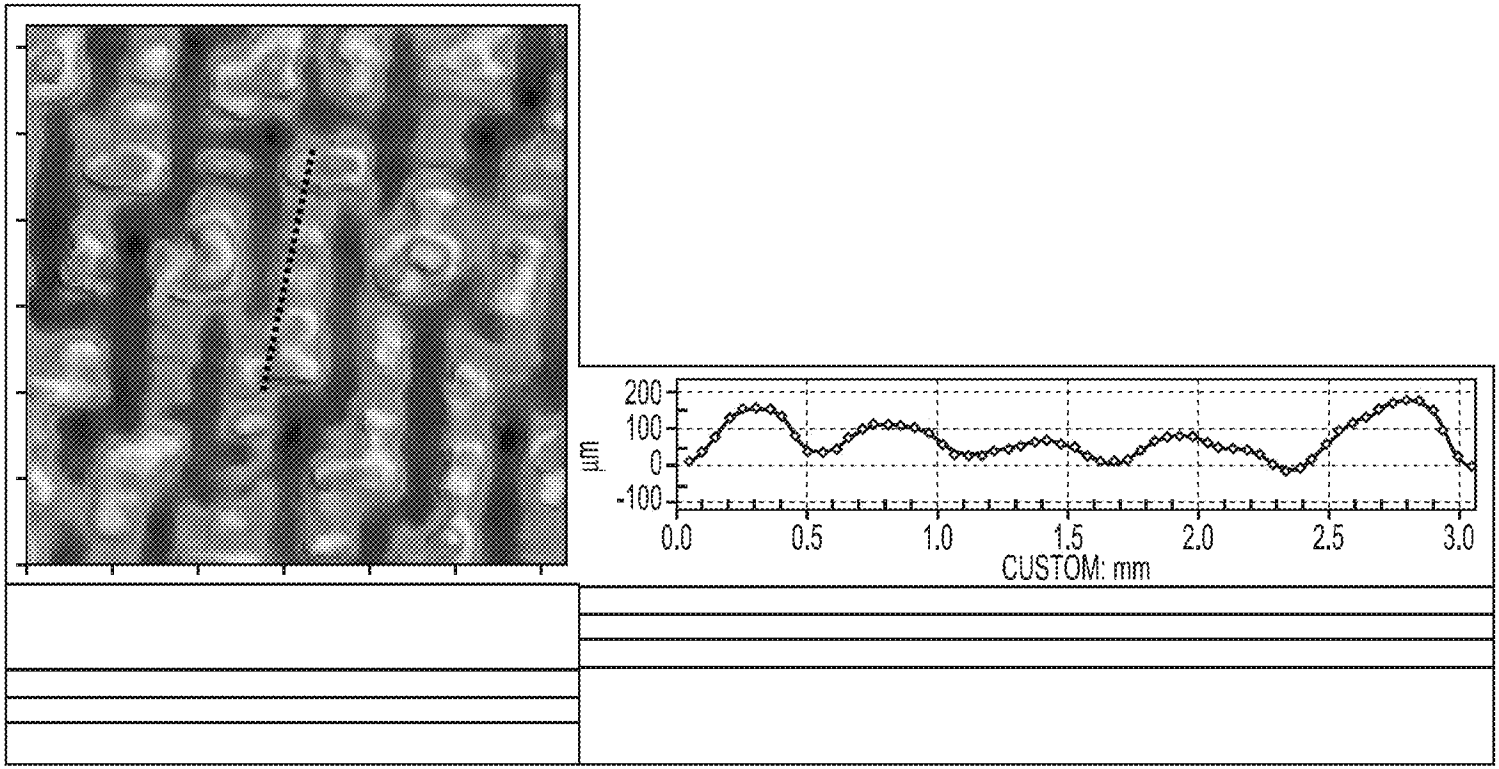
Figure 11A:
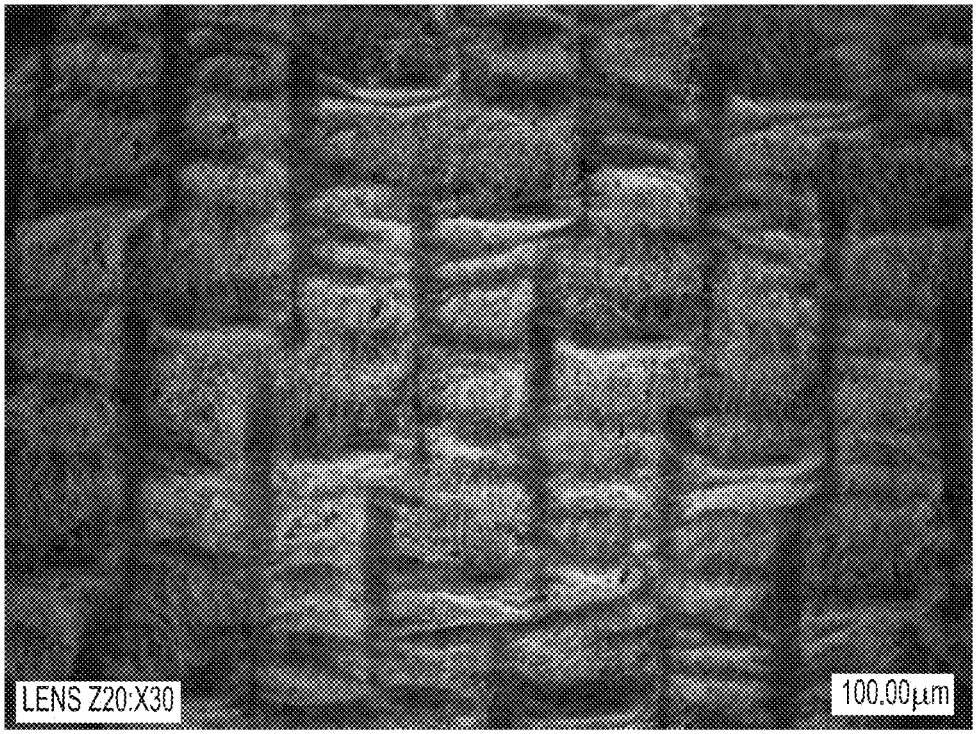
FIGS. 11A-11E are photographs of absorbent sheets according to embodiments of our invention.
Figure 11B:
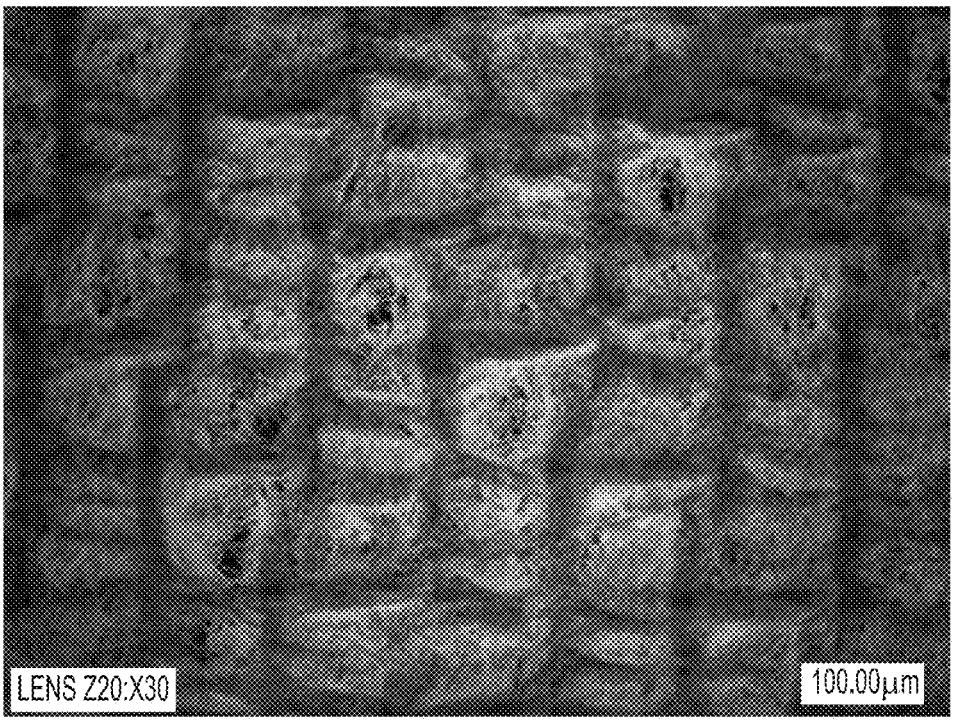
Figure 11C:
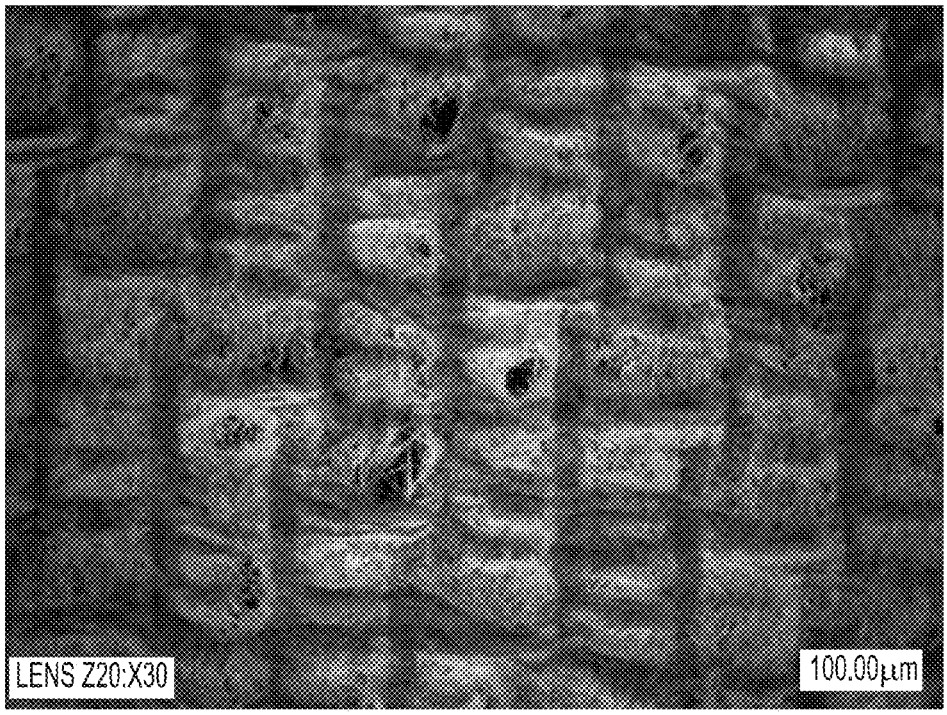
Figure 11D:
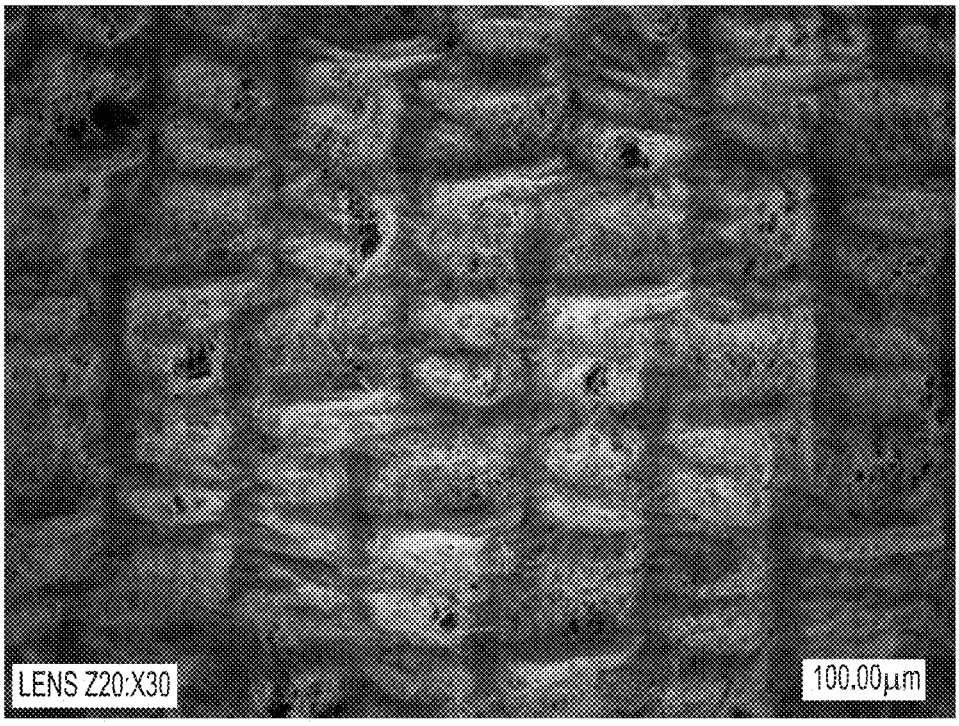
Figure 11E:
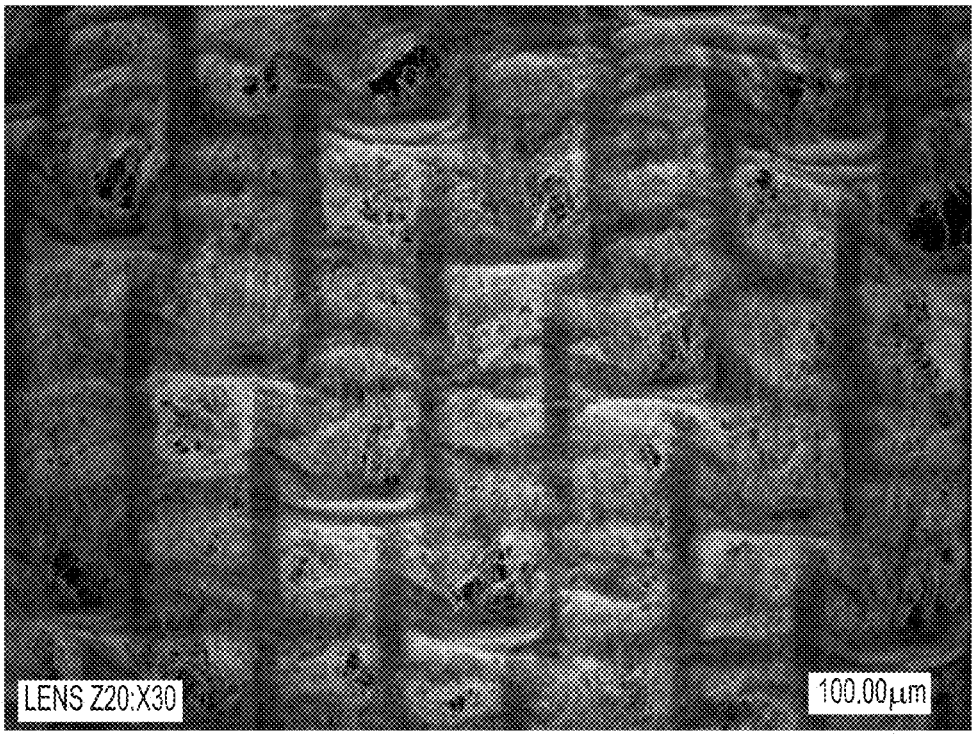
Figure 12A:
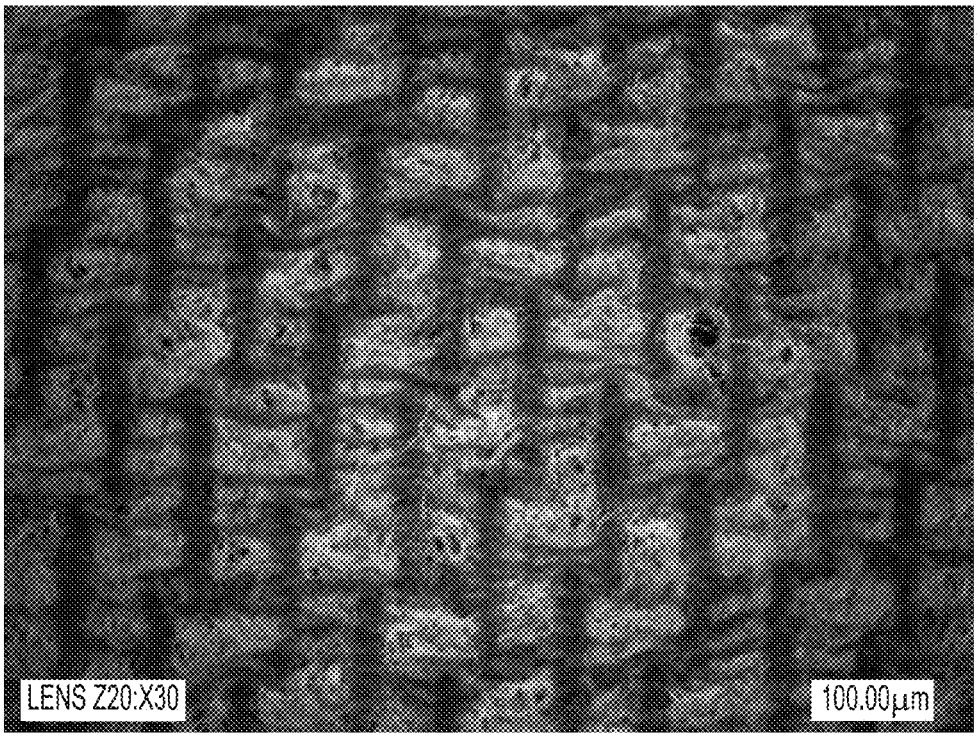
FIGS. 12A-12E are photographs of further absorbent sheets according to embodiments of our invention.
Figure 12B:
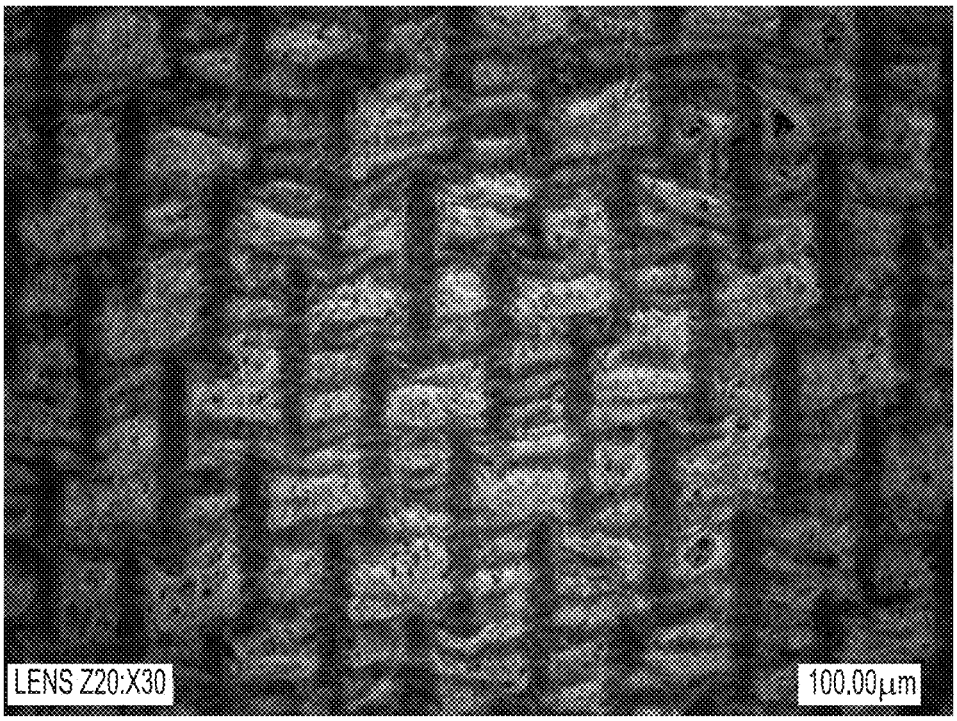
Figure 12C:
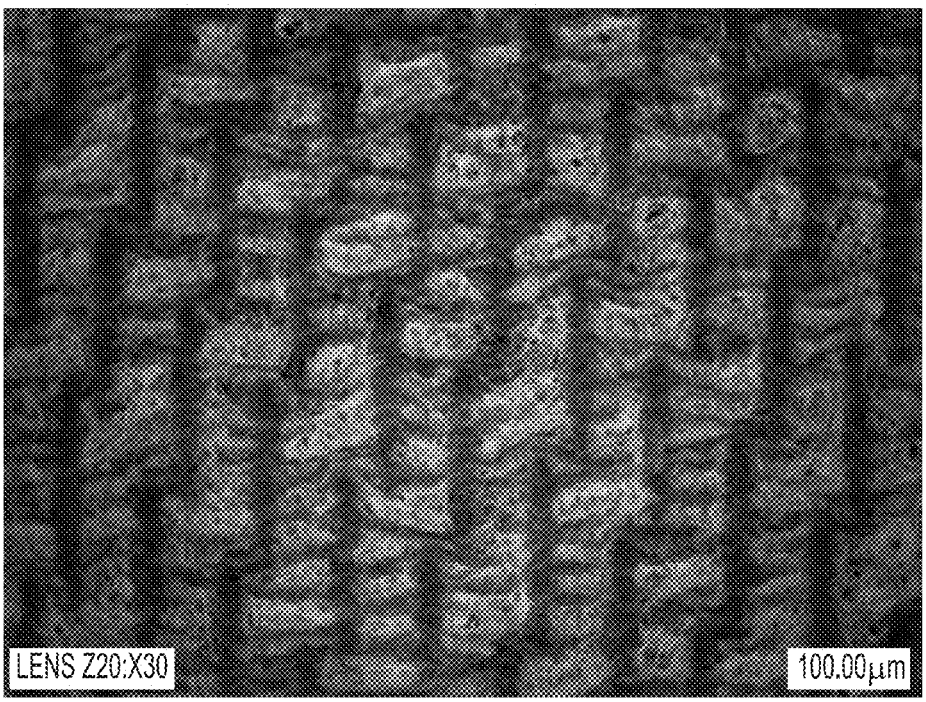
Figure 12D:
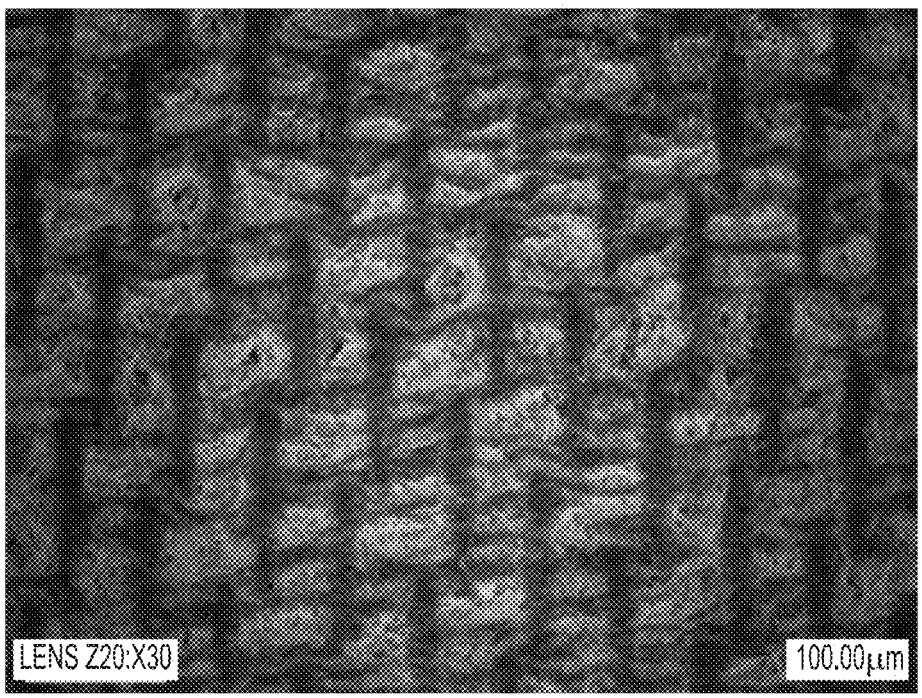
Figure 12E:
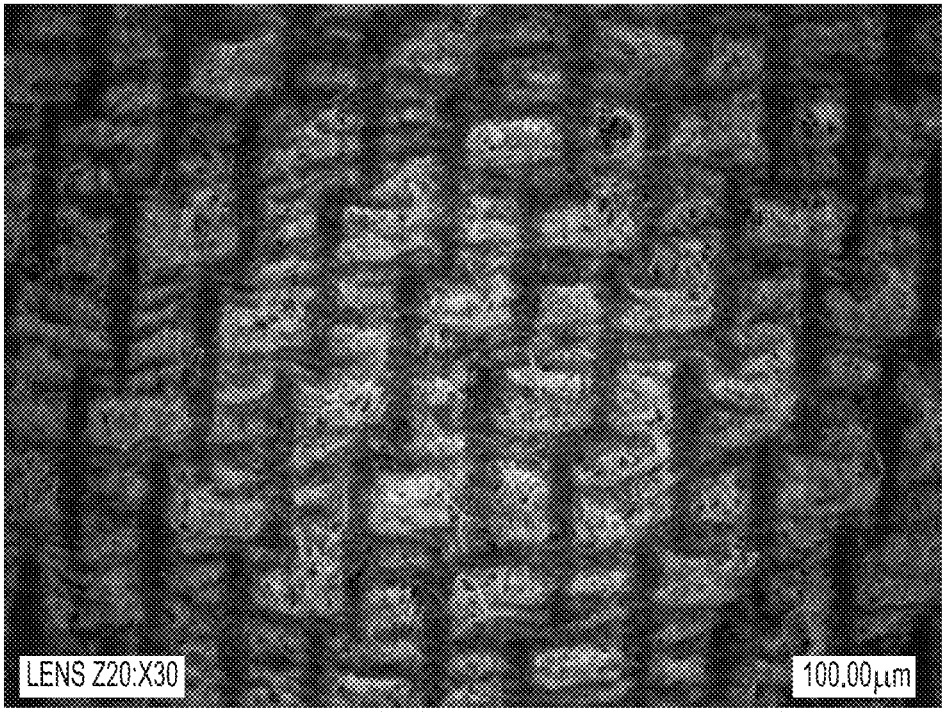

The lengths and depths of the indented bars in absorbent sheets, as well as the lengths of the domed regions, can be determined from a surface profile of a domed region that is made using laser scanning techniques, which are well known in the art. FIGS. 7A and 7B show laser scans profiles across domed regions in two absorbent sheets according to our invention. The peaks of the laser scan profiles are the areas of the domes that are adjacent to the indented bars, while the valleys of the profiles represent the bottoms of the indented bars. Using such laser scan profiles, we have found that the indented bars extend to a depth of about 45 microns to about 160 microns below the tops of the adjacent areas of the domed regions. In a particular embodiment, the indented bars extend an average (mean) of about 90 microns below the tops of the adjacent areas of the domed regions. In some embodiments, the domed regions extend a total of about 2.5 mm to about 3 mm in length in a substantially MD of the absorbent sheets. Those skilled in the art will appreciate that such lengths in the MD of the domed regions are greater than the lengths of domed regions in conventional fabrics, and that the long domed regions are at least partially the result of the long MD pockets in the structuring fabrics used to create the absorbent sheets, as discussed above. From the laser scan profiles, it can also be seen that the indented bars were spaced about 0.5 mm apart along the lengths of the domed regions in embodiments of our invention.

Further distinct features that can be seen in the absorbent sheets shown in FIGS. 4A-4E and 5 include the dome regions being bilaterally staggered in the MD such that substantially continuous, stepped lines of domed regions extend in the MD of the sheets. For example, with reference again to FIG. 5, the domed region 1010 is positioned adjacent to the domed region 1020, with the two domed regions overlapping in a region 1090. Similarly, the domed region 1020 overlaps domed region 1030 in a region 1095. The bilaterally staggered domed regions 1010, 1020, and 1030 form a continuous, stepped line, substantially along the MD of the absorbent sheet 1000. Other domed regions form similar continuous, stepped lines in the MD.

We believe that the configuration of the elongated, bilaterally staggered domed regions, in combination with the indented bars extending across the domed regions, results in the absorbent sheets having a more stable configuration. For example, the bilaterally staggered domed regions provides for a smooth planar surface on the Yankee side of the absorbent sheets, which thereby results in a better distribution of pressure points on the absorbent sheet (the Yankee side of an absorbent sheet being the side of the absorbent sheets that is opposite to the air side of the absorbent sheets that is drawn into the structuring fabric during the papermaking process). In effect, the bilaterally staggered domed regions act like long boards in the MD direction that cause the absorbent sheet structure to lay flat. This effect, resulting from the combination of bilaterally staggered domed regions and indented bars will, for example, cause a web to better lay down on the surface of a Yankee dryer during a papermaking process, which results in better absorbent sheets.

Similar to the continuous lines of domed regions, substantially continuous lines of connecting regions extend in a stepped manner along the MD of the absorbent sheet 1000. For example, connection region 1015, which runs substantially in the CD, is contiguous with connecting region 1025, which runs substantially in the CD. Connecting region 1025 is also contiguous with connecting region 1035, which runs substantially in the MD. Similarly, connecting region 1015 is contiguous with connecting region 1025 and connecting region 1055. In sum, the MD connecting regions are substantially longer than the CD connecting regions, such that lines of stepped, continuous connecting regions can be seen along the absorbent sheet.

As discussed above, the sizes of the domed regions and the connecting regions of an absorbent sheet generally correspond to the pocket and knuckle sizes in the structuring fabric used to produce the absorbent sheet. In this regard, we believe that the relative sizing of the domed and connecting regions contributes to the softness of absorbent sheets made with the fabric. We also believe that the softness is further improved as a result of the substantially continuous lines of domed regions and connecting regions. In a particular embodiment of our invention, a distance in the CD across the domed regions is about 1.0 mm, and a distance in the CD across the MD oriented connecting regions is about 0.5 mm. Further, the overlap/touching regions between adjacent domed regions in the substantially continuous lines are about 1.0 mm in length along the MD. Such dimensions can be determined from a visual inspection of the absorbent sheets, or from a laser scan profile as described above. An exceptionally soft absorbent sheet can be achieved when these dimensions are combined with the other features of our invention described herein.

In order to evaluate the properties of products according to our invention, absorbent sheets were made using Fabric 15 as shown FIG. 3E in a papermaking machine having the general configuration shown in FIG. 1 with a process as described above. For comparison, products were made using the shorter warp length knuckle Fabric 17 that is also shown in FIG. 3F under the same process conditions. Parameters used to produce basesheets for these trials are shown in TABLE 1.

TABLE 1

| Process Variable | Location | Rate |
|---|---|---|
| Furnish:<br>65% SHWK<br>35% SSWK | 100% SHWK to Yankee layer<br>70% SSWK and 30% SHWKK<br>to middle and air layers | Stratified |
| Refiner | Stock | Vary as needed |
| Temporary Wet Strength Resin:<br>FJ98 | Stock pumps | 3 lb/T |
| Starch:<br>REDIBOND ™ 5330A | Static mixers | 8 lb/T |
| Crepe Roll Load | Crepe Roll | 45 PLI |
| Fabric Crepe | Crepe Roll | 20% |
| Reel Crepe | Reel | 7% |
| Calender Load | Calender Stacks | As needed |
| Molding Box Vacuum | Molding Box | Maximum |

The basesheets were converted to produce two-ply glued tissue prototypes. TABLE 2 shows the converting specifications for the trials.

TABLE 2

| Conversion Process | Gluing |
|---|---|
| Number of Plies | 2 |
| Roll Diameter | 4.65 in. |
| Sheet Count | 190 |
| Sheet Length | 4.09 in. |
| Sheet Width | 4.05 in. |
| Roll Compression | 18-20% |
| Emboss Process | Following process of U.S. Pat. No. 6,827,819 (which is incorporated by reference in its entirety) |
| Emboss Pattern | Constant/Non-Varying |

Sheets formed in the trials with Fabric 15 (i.e., a long warp knuckle fabric) were found to be smoother and softer than the sheets formed in the trials with Fabric 17 (i.e., a shorter warp knuckle fabric). Other important properties of the sheets made with Fabric 15, such as caliper and bulk, were found to be very comparable to those properties of the sheets made with Fabric 17. Thus, it is clear that the basesheets made with the long warp knuckle Fabric 15 could potentially be used to make absorbent products that are softer than absorbent products with the shorter warp knuckle Fabric 17 without the reduction of other important properties of the absorbent products.

As described in the aforementioned fabric characterization patents, the planar volumetric index (PVI) is a useful parameter for characterizing a structuring fabric. The PVI for a structuring fabric is calculated as the contact area ratio (CAR) multiplied by the effective pocket volume (EPV) multiplied by one hundred, where the EPV is the product of the pocket area estimate (PA) and the measured pocket depth. The pocket depth is most accurately calculated by measuring the caliper of a handsheet formed on the structuring fabric in a laboratory, and then correlating the measured caliper to the pocket depth. And, unless otherwise noted, all of the PVI-related parameters described herein were determined using this handsheet caliper measuring method. Further, a non-rectangular, parallelogram PVI is calculated as the contact area ratio (CAR) multiplied by the effective pocket volume (EPV) multiplied by one hundred, where the CAR and EPV are calculated using a non-rectangular, parallelogram unit cell area calculation. In embodiments of our invention, the contact area of the structuring long warp knuckle fabric varies between about 25% to about 35% and the pocket depth varies between about 100 microns to about 600 microns, with the PVI thereby varying accordingly.

Another useful parameter for characterizing a structuring fabric related to the PVI is a planar volumetric density index (PVDI) of the structuring fabric. The PVDI of a structuring fabric is defined as the PVI multiplied by pocket density. Note that in embodiments of our invention, the pocket density varies between about 10 cm−2 to about 47 cm−2. Yet another useful parameter of a structuring fabric can be developed by multiplying the PVDI by the ratio of the length and width of the knuckles of the fabric, thereby providing a PVDI-knuckle ratio (PVDI-KR). For example, a PVDI-KR for a long warp knuckle structuring fabric as described herein would be the PVDI of the structuring fabric multiplied by the ratio of warp knuckles length in the MD to the warp knuckles width in the CD. As is apparent from the variables used to calculate the PVDI and PVDI-KR, these parameters take into account important aspects of a structuring fabric (including percentage of contact area, pocket density, and pocket depth) that affect shapes of paper products made using the structuring fabric, and, hence, the PVDI and PVDI-KR may be indicative of the properties of the paper products such as softness and absorbency.

The PVI, PVDI, PVDI-KR, and other characteristics were determined for three long warp knuckle structuring fabrics according to embodiments of our invention, with the results being shown as Fabrics 18-20 in FIG. 8. For comparison, the PVI, PVDI, PVDI-KR, and other characteristics were also determined for a shorter warp knuckle structuring fabric, as is shown as Fabric 21 in FIG. 8. Notably, the PVDI-KRs for Fabrics 18-20 are about 43 to about 50, which are significantly greater than the PVDI-KR of 16.7 for Fabric 21.

Fabrics 18-21 were used to produce absorbent sheets, and characteristics of the absorbent sheets were determined, as shown in FIG. 9. The characteristics shown in FIG. 9 were determined using the same techniques that are described in the aforementioned fabric characterization patents. In this regard, the determinations of the interconnecting regions correspond to the warp knuckles on the structuring fabric, and the dome regions correspond to the pockets of the structuring fabric. Also, it could again be seen that the sheets made from the long warp knuckle Fabrics 18-20 have multiple indented bars in each dome region. On the other hand, the domed regions of the absorbent sheet formed from the shorter warp knuckle Fabric 21 had, at most, one indented bar, and many of the domed regions did not have any indented bars at all.

The sensory softness was determined for the absorbent sheets shown in FIG. 9. Sensory softness is a measure of the perceived softness of a paper product as determined by trained evaluators using standardized testing techniques. More specifically, sensory softness is measured by evaluators experienced with determining the softness, with the evaluators following specific techniques for grasping the paper and ascertaining a perceived softness of the paper. The higher the sensory softness number, the higher the perceived softness. In the case of the sheets made from Fabrics 18-20, it was found that the absorbent sheets made with Fabrics 18-20 were 0.2 to 0.3 softness units higher than the absorbent sheets made with Fabric 21. This difference is outstanding. Moreover, the sensory softness was found to correlate with the PVDI-KR of the fabrics. That is, the higher the PVDI-KR of the structuring fabric, the higher the sensory softness number that was achieved. Thus, we believe that PVDI-KR is a good indicator of the softness that can be achieved in a paper product made with a process using a structuring fabric, with a higher PVDI-KR structuring fabric producing a softer product.

FIGS. 10A through 10D show characteristics of further long-warp knuckle Fabrics 22-41 according to various embodiments of our invention, including the PVI, PVDI, and PVDI-KR for each of the fabrics. Notably, these structuring fabrics have a wider range of characteristics than the structuring fabrics described above. For example, contact lengths of the warp knuckles of Fabrics 22-41 ranged from about 2.2 mm to about 5.6 mm. In further embodiments of our invention, however, the contact lengths of the warp knuckles may range from about 2.2 mm to about 7.5 mm. Note that in the case of Fabrics 22-37 and 41, the pocket depths were determined by forming a handsheet on the fabrics and then determining the size of domes on the handsheet (the size of the domes corresponding to the size of the pockets, as described above). The pocket depths for Fabrics 38-40 were determined using techniques set forth in the aforementioned fabric characterization patents.

Further trials were conducted to evaluate properties of absorbent sheets according to embodiments of our invention. In these trials, the Fabrics 27 and 38 were used. For these trials, a papermaking machine having the general configuration shown in FIG. 1 was used with a process as described above. Parameters used to produce the basesheets for these trials are shown in TABLE 3. Note that an indication of a varying rate means that the process variable was varied in different trial runs.

TABLE 3

| Process Variable | Location | Rate |
|---|---|---|
| Furnish | Lighthouse Recycled Fibers | Homogeneous |
| Refiner | Stock | No load (22 hp) |
| Temporary Wet Strength Resin | N/A | 0 |
| Starch: REDIBOND ™ 5330A | Static mixers | As needed |
| Crepe Roll Load | Crepe Roll | 30-40 PLI |
| Fabric Crepe | Crepe Roll | varying 25%-35% |
| Reel Crepe | Reel | 2-4% |
| Molding Box Vacuum | Molding Box | Maximum |

The basesheets in these trials were converted into unembossed, single-ply rolls.

Pictures of the absorbent sheets made with Fabric 27 are shown in FIGS. 11A-11E and pictures of the absorbent sheets made with Fabric 38 are shown in FIGS. 12A-12E. As is apparent from FIGS. 11A-11E and 12A-12E, the domed regions of the absorbent sheets included a plurality of indented bars like the absorbent sheets described above. And, also like the absorbent sheets described above, the absorbent sheets made with Fabrics 27 and 38 include bilaterally staggered domed regions that result in substantially continuous, stepped lines in the MD of the absorbent sheets, and substantially continuous, stepped connecting regions between the domed regions.

The profiles of the domed regions in the basesheets made from Fabrics 27 and 38 were determined using laser scanning, in the same manner that the profiles were determined in the absorbent sheets described above. It was found that the domed regions in the basesheets made with Fabric 27 had 4 to 7 indented bars, with there being an average (mean) of 5.2 indented bars per domed region. The indented bars of domed regions extended from about 132 to about 274 microns below the tops of adjacent areas of the domed regions, with an average (mean) depth of about 190 microns. Further, the domed regions extended about 4.5 mm in the MD of the basesheets.

The domed regions in the basesheets made with Fabric 38 had 4 to 8 indented bars, with there being an average (mean) of 6.29 indented bars per domed region. The indented bars of domed regions in the basesheets made with Fabric 38 extended from about 46 to about 159 microns below the tops of adjacent areas of the domed regions, with an average (mean) depth of about 88 microns. Further, the domed regions extended about 3 mm in the MD of the basesheets.

Because the extended MD direction domed regions in the basesheets made with Fabrics 27 and 38 include a plurality of indented bars, it follows that the basesheets will have similar beneficial properties stemming from the configuration of the domed regions as the absorbent sheets described above. For example, the basesheets made with Fabrics 27 and 38 will be softer to the touch compared to basesheets made with fabrics not having long warp knuckles.

Other properties of the basesheets made with Fabrics 27 and 38 were compared to the properties of basesheets made with shorter knuckle fabrics. Specifically, the caliper and pocket depth were compared for uncalendered basesheets made with the different fabrics. The caliper was measured using standard techniques that are well known in the art. It was found that the caliper of the basesheets made with Fabric 27 varied from about 80 mils/8 sheets to about 110 mils/8 sheets, while the basesheets made with Fabric 38 varied from about 80 mils/8 sheets to about 90 mils/8 sheets. Both of these ranges of caliper are very comparable, if not better than, the about 60 to about 93 mils/8 sheets caliper that was found in the basesheets made with shorter warp yarn knuckle fabrics under similar process conditions.

The depths of the domed regions were measured using a topographical profile scan of the air side (i.e, the side of the basesheets that contacts the structuring fabric during the papermaking process) of the basesheets to determine the depths of the lowest points of domed regions below the Yankee side surface. The depths of the domed regions in the basesheets made using Fabric 27 ranged from about 500 microns to about 675 microns, while the depths of the domed regions in the basesheets made using Fabric 38 ranged from about 400 microns to about 475 microns. These domed regions were comparable to, if not greater than, the depths of the domed regions in basesheets made from the structuring fabrics having shorter warp yarn knuckles. This comparability of the depths of domed regions is consistent with the finding that the basesheets made with the long warp yarn structuring fabrics having comparable caliper to the basesheets made with the shorter warp yarn structuring fabrics inasmuch as the depth of domed regions is directly related to the caliper of an absorbent sheet.

Figure 14:
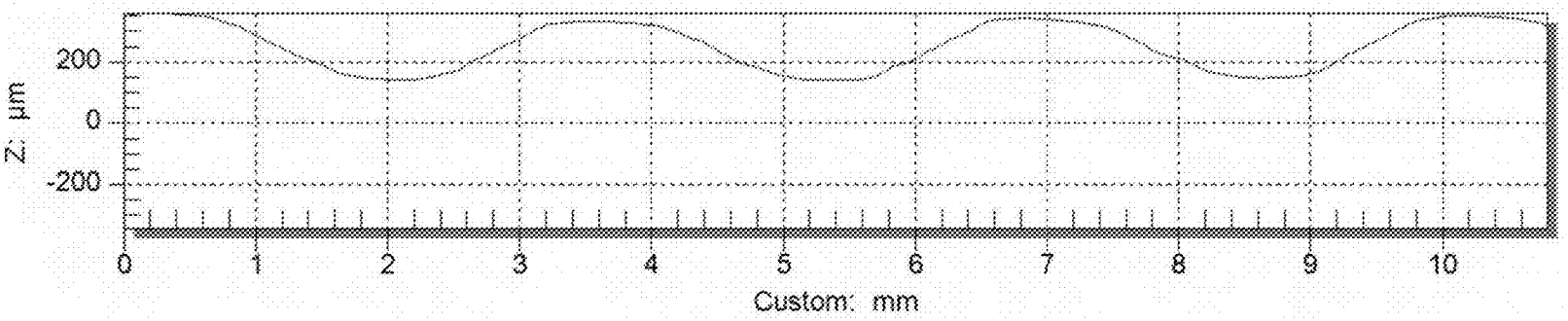
FIG. 14 shows a measurement of a profile along one of the warp yarns of a structuring fabric according to an embodiment of our invention.

The characteristics of further long warp yarn knuckle fabrics according to our invention are labeled as Fabrics 42-44 in FIG. 13. Also shown in FIG. 13 is a conventional Fabric 45 that does not include long warp yarn knuckles. Further characteristics of Fabric 42 are given in FIG. 14, which shows the profile along one of the warp yarns of the fabric. As can be seen in these figures, Fabric 42 has several notable features in addition to including long warp yarn knuckles. One feature is that the pockets are long and deep, as reflected in the PVI related parameters indicated in FIG. 13. As can also be seen in the pressure imprint of Fabric 42 shown in FIG. 13, another notable feature of this fabric is that the CD yarns are entirely located below the plane of the knuckles in the MD yarns such that there are no CD knuckles at the top surface of the fabric. Because there are no CD knuckles, there is a gradual slope to the warp yarns in the z-direction, the details of which are shown in the profile scan in FIG. 14. As indicated in this figure, the warp yarns have a slope of about 200 μm/mm from the lowest point where the warp yarns pass under a CD yarn to the top of the adjacent warp knuckle. More generally speaking, the warp yarns are angled from about 11 degrees relative to a plane that Fabric moves along during the creping operation. It is believed that this gradual slope of the warp yarns allows the fibers in a web being pressed to Fabric 42 to only slightly pile up on the sloped portion of the warp yarn before being some of the fibers slip up over the top of the adjacent knuckle. The gradual slope of the warp yarns in Fabric 42 thereby creates less of an abrupt stop for the fibers of the web and less densification of the fibers compared to other fabrics where the warp yarns have a steeper slope that is contacted by the web.

Fabrics 42 and 43 both have higher PVDI-KR values, and these values in conjunction with the PVDI-KR values of the other structuring fabrics described herein are generally indicative of the range of PVDI-KR values that can be found in embodiments of our invention. Further, structuring fabrics with even higher PVDI-KR values could also be used, for example, up to about 250.

In order to evaluate the properties of Fabric 42, a series of trials was conducted with this fabric and with Fabric 45 for comparison. In these trials, a papermaking machine having the general configuration shown in FIG. 1 was used to form absorbent towel basesheets. The non-TAD process described generally above and specifically set forth in the aforementioned '563 patent was used, wherein the web was dewatered to the point that it had a consistency of about 40 to about 43 percent when transferred onto the top side of the structuring fabric (i.e., Fabric 42 or 45) at the creping nip. Other particular parameters of these trails were as shown in TABLE 4.

TABLE 4

| Process Variable | Location | Rate |
|---|---|---|
| Furnish | Premium ("P"):<br>70% NSWK/30% *Eucalyptus*.<br>or<br>Non-premium ("NP"):<br>70% SSWK/30% SHWK | Stratified |
| Refiner | Stock | Varies |
| WSR/CMC (#/T total) | Static Mixer | 20/3.2 |
| Debonder Addition | None | None |
| Crepe Roll Load | Crepe Roll | 40-60 PLI |
| Fabric Crepe | Crepe Roll | As indicated in tables below |
| Reel Crepe | Reel | 2% |
| Molding Box Vacuum | Molding Box | Varying between full and zero |

The properties of the basesheets made in these trials with Fabrics 42 and 45 are shown in TABLES 5-9. The testing protocols used to determine the properties indicated in TABLES 5-9 can be found in U.S. Pat. Nos. 7,399,378 and 8,409,404, which are incorporated herein by reference in their entirety. An indication of "N/C" indicates that a property was not calculated for a particular trial.

TABLE 5

| | Trial | | | | | | | | | | |
|---|---|---|---|---|---|---|---|---|---|---|---|
| | 1 | 2 | 3 | 4 | 5 | 6 | 7 | 8 | 9 | 10 | 11 |
| Fabric | 45 | 45 | 45 | 45 | 45 | 45 | 45 | 45 | 45 | 45 | 45 |
| Fabric Crepe (%) | 3 | 3 | 5 | 5 | 8 | 8 | 15 | 15 | 20 | 20 | 30 |
| Furnish | NP | NP | NP | NP | NP | NP | NP | NP | NP | NP | NP |
| Caliper (mils/8 sheets) | 63.18 | 62.93 | 68.20 | 67.35 | 77.98 | 77.53 | 84.98 | 88.43 | 92.38 | 90.55 | 99.38 |

TABLE 5-continued

| | Trial | | | | | | | | | | |
|---|---|---|---|---|---|---|---|---|---|---|---|
| | 1 | 2 | 3 | 4 | 5 | 6 | 7 | 8 | 9 | 10 | 11 |
| Basis Weight (lb/3000 $ft^2$) | 15.17 | 15.42 | 15.33 | 15.38 | 15.31 | 15.34 | 15.59 | 15.28 | 15.85 | 15.50 | 15.47 |
| MD Tensile (g/3 in) | 1590 | 1554 | 1353 | 1639 | 1573 | 1498 | 1387 | 1445 | 1401 | 1145 | 1119 |
| MD Stretch (%) | 8.1 | 8.9 | 9.8 | 10.3 | 13.1 | 12.4 | 20.1 | 18.8 | 24.2 | 24.5 | 33.9 |
| CD Tensile (g/3 in) | 1393 | 1382 | 1294 | 1420 | 1393 | 1428 | 1401 | 1347 | 1231 | 1200 | 1272 |
| CD Stretch (%) | 4.5 | 4.8 | 4.5 | 4.7 | 4.9 | 4.9 | 6.1 | 7.1 | 6.1 | 6.0 | 7.0 |
| Wet Tensile Finch Cured-CD (g/3 in) | 378.42 | 377.31 | 396.72 | 426.79 | 392.27 | 399.08 | 389.35 | 359.39 | 381.15 | 383.22 | 388.66 |
| SAT Capacity ($g/m^2$) | 303.76 | 316.09 | 329.09 | 339.94 | 369.38 | 362.64 | 421.02 | 415.43 | 454.08 | 420.03 | 486.14 |
| GM Tensile (g/3 in) | 1488 | 1466 | 1323 | 1526 | 1481 | 1462 | 1394 | 1395 | 1313 | 1172 | 1193 |
| GM Break Modulus (g/%) | 254.08 | 227.72 | 198.96 | 220.16 | 186.53 | 189.30 | 130.30 | 116.76 | 108.50 | 97.10 | 78.67 |
| SAT Time (s) | N/C | N/C | N/C | N/C | 47.3 | 47.3 | N/C | N/C | N/C | N/C | N/C |
| Tensile Dry Ratio | 1.14 | 1.12 | 1.05 | 1.15 | 1.13 | 1.05 | 0.99 | 1.07 | 1.14 | 0.95 | 0.88 |
| SAT Rate $g/s^{0.5}$ | N/C | N/C | N/C | N/C | 0.1233 | 0.1073 | N/C | N/C | N/C | N/C | N/C |
| Tensile Total Dry (g/3 in) | 2983 | 2937 | 2647 | 3059 | 2967 | 2926 | 2788 | 2792 | 2632 | 2345 | 2391 |
| Tensile Wet/Dry CD | 0.27 | 0.27 | 0.31 | 0.30 | 0.28 | 0.28 | 0.28 | 0.27 | 0.31 | 0.32 | 0.31 |
| Basis Weight Raw Wt (g) | 1.147 | 1.166 | 1.159 | 1.163 | 1.158 | 1.160 | 1.179 | 1.156 | 1.198 | 1.172 | 1.170 |
| T.E.A. CD ($mm\text{-}g/mm^2$) | 0.386 | 0.388 | 0.370 | 0.439 | 0.448 | 0.434 | 0.505 | 0.537 | 0.472 | 0.445 | 0.521 |
| T.E.A. MD ($mm\text{-}g/mm^2$) | 0.693 | 0.759 | 0.733 | 0.911 | 1.043 | 0.982 | 1.461 | 1.400 | 1.700 | 1.431 | 1.993 |
| CD Break Modulus (g/%) | 314.12 | 292.46 | 274.57 | 305.26 | 283.37 | 297.78 | 240.35 | 171.68 | 200.07 | 199.94 | 190.52 |
| MD Break Modulus (g/%) | 205.51 | 177.30 | 144.18 | 158.79 | 122.78 | 120.33 | 70.64 | 79.40 | 58.84 | 47.16 | 32.48 |

TABLE 6

| | Trial | | | | | | | | | | |
|---|---|---|---|---|---|---|---|---|---|---|---|
| | 12 | 13 | 14 | 15 | 16 | 17 | 18 | 19 | 20 | 21 | 22 |
| Fabric | 45 | 45 | 42 | 42 | 42 | 42 | 42 | 42 | 42 | 42 | 42 |
| Fabric Crepe (%) | 30 | 40 | 5 | 5 | 8 | 8 | 12 | 12 | 15 | 15 | 17.5 |
| Furnish | NP | NP | NP | NP | NP | NP | NP | NP | NP | NP | NP |
| Caliper (mils/8 sheets) | 100.03 | 103.35 | 104.73 | 101.30 | 103.33 | 106.95 | 112.40 | 111.78 | 115.83 | 124.73 | 118.75 |
| Basis Weight (lb/3000 $ft^2$) | 15.48 | 15.89 | 15.55 | 15.71 | 15.16 | 15.77 | 15.52 | 14.99 | 15.62 | 15.46 | 15.54 |
| MD Tensile (g/3 in) | 1191 | 1310 | 1346 | 1404 | 1217 | 1381 | 1205 | 1118 | 1139 | 1193 | 1100 |
| MD Stretch (%) | 33.8 | 42.1 | 9.4 | 9.2 | 11.9 | 13.6 | 16.3 | 16.8 | 18.5 | 18.6 | 22.5 |
| CD Tensile (g/3 in) | 1216 | 1091 | 1221 | 1171 | 1164 | 1305 | 1229 | 1187 | 1208 | 1273 | 1186 |
| CD Stretch (%) | 6.4 | 9.7 | 6.7 | 6.5 | 7.6 | 6.7 | 8.2 | 9.0 | 8.9 | 7.3 | 8.4 |
| Wet Tensile Finch Cured-CD (g/3 in) | 375.14 | 333.25 | 384.19 | 341.28 | 334.01 | 391.05 | 383.33 | 356.94 | 367.40 | 386.18 | 398.40 |
| SAT Capacity ($g/m^2$) | 482.86 | N/C | 421.51 | 426.61 | 457.53 | 455.88 | 479.24 | 509.33 | 533.67 | 491.24 | 515.91 |
| GM Tensile (g/3 in) | 1203 | 1195 | 1282 | 1283 | 1191 | 1343 | 1217 | 1152 | 1173 | 1232 | 1142 |
| GM Break Modulus (g/%) | 84.14 | 59.92 | 162.90 | 168.66 | 128.36 | 141.14 | 105.49 | 93.56 | 94.07 | 106.55 | 84.05 |
| SAT Time (s) | N/C | N/C | 58.5 | 55.9 | 48.4 | 62.4 | 46.9 | 46.6 | 43.8 | 39.6 | 40.8 |
| Tensile Dry Ratio | 0.98 | 1.20 | 1.10 | 1.20 | 1.05 | 1.06 | 0.98 | 0.94 | 0.94 | 0.94 | 0.93 |
| SAT Rate $g/s^{0.5}$ | N/C | N/C | 0.1240 | 0.1250 | 0.1460 | 0.1330 | 0.1463 | 0.1703 | 0.1787 | 0.1653 | 0.1747 |
| Tensile Total Dry (g/3 in) | 2406 | 2401 | 2568 | 2576 | 2382 | 2686 | 2434 | 2305 | 2347 | 2466 | 2286 |
| Tensile Wet/Dry CD | 0.31 | 0.31 | 0.31 | 0.29 | 0.29 | 0.30 | 0.31 | 0.30 | 0.30 | 0.30 | 0.34 |

TABLE 6-continued

| | Trial | | | | | | | | | | |
|---|---|---|---|---|---|---|---|---|---|---|---|
| | 12 | 13 | 14 | 15 | 16 | 17 | 18 | 19 | 20 | 21 | 22 |
| Basis Weight Raw Wt (g) | 1.170 | 1.202 | 1.176 | 1.188 | 1.146 | 1.193 | 1.173 | 1.134 | 1.181 | 1.169 | 1.175 |
| T.E.A. CD (mm-g/mm$^2$) | 0.493 | 0.614 | 0.486 | 0.458 | 0.504 | 0.520 | 0.561 | 0.586 | 0.600 | 0.527 | 0.555 |
| T.E.A. MD (mm-g/mm$^2$) | 2.102 | 2.729 | 0.854 | 0.875 | 0.965 | 1.147 | 1.262 | 1.191 | 1.326 | 1.397 | 1.476 |
| CD Break Modulus (g/%) | 200.28 | 115.03 | 186.61 | 185.12 | 160.98 | 196.28 | 149.84 | 131.23 | 142.85 | 172.21 | 141.16 |
| MD Break Modulus (g/%) | 35.35 | 31.21 | 142.20 | 153.67 | 102.35 | 101.49 | 74.26 | 66.71 | 61.95 | 65.93 | 50.04 |

TABLE 7

| | Trial | | | | | | | | | | |
|---|---|---|---|---|---|---|---|---|---|---|---|
| | 23 | 24 | 25 | 26 | 27 | 28 | 29 | 30 | 31 | 32 | 33 |
| Fabric | 42 | 42 | 42 | 42 | 42 | 42 | 42 | 42 | 42 | 42 | 42 |
| Fabric Crepe (%) | 17.5 | 20 | 20 | 25 | 25 | 3 | 3 | 5 | 5 | 8 | 8 |
| Furnish | NP | NP | NP | NP | NP | P | P | P | P | P | P |
| Caliper (mils/8 sheets) | 120.55 | 125.73 | 119.30 | 119.08 | 117.58 | 88.60 | 80.00 | 102.35 | 99.75 | 106.93 | 113.50 |
| Basis Weight (lb/3000 ft$^2$) | 15.36 | 15.46 | 15.54 | 15.71 | 15.56 | 15.38 | 15.73 | 15.46 | 15.67 | 15.73 | 15.59 |
| MD Tensile (g/3 in) | 1156 | 1168 | 1218 | 1098 | 1164 | 1545 | 1481 | 1255 | 1336 | 1305 | 1266 |
| MD Stretch (%) | 22.7 | 24.9 | 24.5 | 28.8 | 29.6 | 8.6 | 8.3 | 11.5 | 11.5 | 13.5 | 13.4 |
| CD Tensile (g/3 in) | 1230 | 1137 | 1220 | 1135 | 1160 | 1353 | 1263 | 1171 | 1194 | 1202 | 1145 |
| CD Stretch (%) | 9.5 | 9.8 | 10.1 | 9.0 | 8.7 | 6.6 | 6.6 | 7.4 | 7.7 | 7.1 | 8.4 |
| Wet Tensile Finch Cured-CD (g/3 in) | 389.77 | 355.26 | 412.54 | 353.38 | 358.26 | 394.94 | 400.23 | 365.83 | 380.93 | 404.07 | 342.44 |
| SAT Capacity (g/m$^2$) | 549.13 | 566.40 | 487.13 | 550.61 | 541.90 | 366.91 | 380.56 | 438.45 | 424.80 | 462.79 | 454.57 |
| GM Tensile (g/3 in) | 1192 | 1152 | 1219 | 1116 | 1162 | 1446 | 1368 | 1212 | 1263 | 1252 | 1204 |
| GM Break Modulus (g/%) | 79.01 | 75.16 | 77.59 | 69.14 | 71.02 | 189.84 | 187.19 | 134.80 | 135.76 | 127.34 | 114.64 |
| SAT Time (s) | 46.2 | 82.5 | 61.1 | 49.6 | 46.0 | 59.8 | 61.4 | 60.9 | 61.3 | 63.5 | 58.6 |
| Tensile Dry Ratio | 0.94 | 1.03 | 1.00 | 0.97 | 1.00 | 1.14 | 1.17 | 1.07 | 1.12 | 1.09 | 1.11 |
| SAT Rate g/s$^{0.5}$ | 0.1747 | 0.1410 | 0.1297 | 0.1593 | 0.1613 | 0.0753 | 0.0917 | 0.1230 | 0.1123 | 0.1313 | 0.1263 |
| Tensile Total Dry (g/3 in) | 2386 | 2305 | 2438 | 2233 | 2324 | 2898 | 2744 | 2426 | 2530 | 2506 | 2411 |
| Tensile Wet/Dry CD | 0.32 | 0.31 | 0.34 | 0.31 | 0.31 | 0.29 | 0.32 | 0.31 | 0.32 | 0.34 | 0.30 |
| Basis Weight Raw Wt (g) | 1.162 | 1.169 | 1.175 | 1.188 | 1.176 | 1.163 | 1.189 | 1.169 | 1.185 | 1.190 | 1.179 |
| T.E.A. CD (mm-g/mm$^2$) | 0.638 | 0.647 | 0.652 | 0.610 | 0.613 | 0.503 | 0.492 | 0.505 | 0.533 | 0.501 | 0.514 |
| T.E.A. MD (mm-g/mm$^2$) | 1.520 | 1.661 | 1.710 | 1.849 | 1.965 | 0.843 | 0.784 | 0.924 | 0.965 | 1.090 | 1.054 |
| CD Break Modulus (g/%) | 121.69 | 118.88 | 118.90 | 125.56 | 129.39 | 202.35 | 193.60 | 160.78 | 156.90 | 165.68 | 136.75 |
| MD Break Modulus (g/%) | 51.31 | 47.52 | 50.63 | 38.07 | 38.99 | 178.10 | 181.00 | 113.03 | 117.47 | 97.87 | 96.10 |

TABLE 8

| | Trial | | | | | | | | | |
|---|---|---|---|---|---|---|---|---|---|---|
| | 34 | 35 | 36 | 37 | 38 | 39 | 40 | 41 | 42 | 43 |
| Fabric | 42 | 42 | 42 | 42 | 42 | 42 | 42 | 42 | 42 | 42 |
| Fabric Crepe (%) | 12 | 12 | 15 | 15 | 17.5 | 17.5 | 20 | 20 | 25 | 25 |
| Furnish | P | P | P | P | P | P | P | P | P | P |

TABLE 8-continued

| | Trial | | | | | | | | | |
|---|---|---|---|---|---|---|---|---|---|---|
| | 34 | 35 | 36 | 37 | 38 | 39 | 40 | 41 | 42 | 43 |
| Caliper (mils/8 sheets) | 106.90 | 111.85 | 126.78 | 113.55 | 116.38 | 117.43 | 124.28 | 118.38 | 127.15 | 123.45 |
| Basis Weight (lb/3000 $ft^2$) | 15.25 | 15.52 | 15.28 | 15.56 | 15.22 | 15.13 | 15.27 | 15.36 | 15.73 | 15.66 |
| MD Tensile (g/3 in) | 1285 | 1362 | 1151 | 1099 | 1163 | 1246 | 1311 | 1268 | 1126 | 1114 |
| MD Stretch (%) | 18.0 | 17.8 | 21.4 | 20.1 | 24.2 | 21.7 | 24.1 | 25.6 | 30.0 | 29.5 |
| CD Tensile (g/3 in) | 1263 | 1291 | 1105 | 1239 | 1309 | 1156 | 1279 | 1188 | 1153 | 1215 |
| CD Stretch (%) | 8.9 | 8.2 | 9.8 | 8.9 | 9.8 | 10.1 | 10.4 | 10.4 | 11.3 | 10.8 |
| Wet Tensile Finch Cured-CD (g/3 in) | 361.36 | 377.41 | 363.51 | 382.17 | 382.19 | 340.60 | 364.82 | 370.56 | 380.50 | 371.50 |
| SAT Capacity (g/$m^2$) | 540.09 | 498.97 | 502.43 | 514.43 | 535.48 | 558.67 | 585.81 | 568.05 | 553.90 | 551.76 |
| GM Tensile (g/3 in) | 1274 | 1326 | 1128 | 1167 | 1234 | 1200 | 1295 | 1227 | 1139 | 1163 |
| GM Break Modulus (g/%) | 101.68 | 109.99 | 78.18 | 87.01 | 80.40 | 82.55 | 84.45 | 76.02 | 62.29 | 64.93 |
| SAT Time (s) | 37.5 | 42.7 | 55.4 | 47.3 | 50.2 | 51.4 | 45.1 | 44.3 | 66.6 | 53.5 |
| Tensile Dry Ratio | 1.02 | 1.06 | 1.04 | 0.89 | 0.89 | 1.08 | 1.03 | 1.07 | 0.98 | 0.92 |
| SAT Rate g/$s^{0.5}$ | 0.1637 | 0.1557 | 0.1480 | 0.1570 | 0.1623 | 0.1553 | 0.1753 | 0.1783 | 0.1453 | 0.1483 |
| Tensile Total Dry (g/3 in) | 2548 | 2652 | 2257 | 2338 | 2472 | 2402 | 2589 | 2456 | 2279 | 2328 |
| Tensile Wet/Dry CD | 0.29 | 0.29 | 0.33 | 0.31 | 0.29 | 0.29 | 0.29 | 0.31 | 0.33 | 0.31 |
| Basis Weight Raw Wt (g) | 1.153 | 1.173 | 1.156 | 1.177 | 1.151 | 1.144 | 1.155 | 1.161 | 1.189 | 1.184 |
| T.E.A. CD (mm-g/$mm^2$) | 0.627 | 0.625 | 0.566 | 0.600 | 0.676 | 0.617 | 0.695 | 0.659 | 0.691 | 0.703 |
| T.E.A. MD (mm-g/$mm^2$) | 1.393 | 1.474 | 1.421 | 1.371 | 1.592 | 1.599 | 1.825 | 1.803 | 1.928 | 1.907 |
| CD Break Modulus (g/%) | 145.26 | 158.25 | 111.51 | 137.62 | 134.41 | 116.31 | 128.13 | 116.00 | 101.44 | 113.29 |
| MD Break Modulus (g/%) | 71.18 | 76.45 | 54.81 | 55.01 | 48.09 | 58.59 | 55.66 | 49.82 | 38.25 | 37.21 |

TABLE 9

| Trial | 44 | 45 | 46 | 47 |
|---|---|---|---|---|
| Fabric | 42 | 42 | 42 | 42 |
| Fabric Crepe (%) | 30 | 30 | 35 | 35 |
| Furnish | P | P | P | P |
| Caliper (mils/8 sheets) | 126.38 | 124.25 | 122.83 | 123.23 |
| Basis Weight (lb/3000 $ft^2$) | 15.75 | 15.47 | 15.35 | 14.46 |
| MD Tensile (g/3 in) | 1126 | 1118 | 1157 | 1097 |
| MD Stretch (%) | 35.0 | 35.2 | 33.9 | 34.4 |
| CD Tensile (g/3 in) | 1050 | 1090 | 1083 | 1097 |
| CD Stretch (%) | 11.2 | 10.2 | 10.6 | 10.8 |
| Wet Tensile Finch Cured-CD (g/3 in) | 366.41 | 398.97 | 363.35 | 377.73 |
| SAT Capacity (g/$m^2$) | 549.30 | 522.16 | 544.69 | 533.02 |
| GM Tensile (g/3 in) | 1088 | 1104 | 1119 | 1097 |
| GM Break Modulus (g/%) | 54.29 | 56.95 | 59.34 | 56.65 |
| SAT Time (s) | 51.3 | 66.1 | 58.4 | 53.2 |
| Tensile Dry Ratio | 1.07 | 1.03 | 1.07 | 1.00 |
| SAT Rate g/$s^{0.5}$ | 0.1457 | 0.1330 | 0.1543 | 0.1547 |
| Tensile Total Dry (g/3 in) | 2176 | 2208 | 2240 | 2194 |
| Tensile Wet/Dry CD | 0.35 | 0.37 | 0.34 | 0.34 |
| Basis Weight Raw Wt (g) | 1.191 | 1.170 | 1.161 | 1.093 |
| T.E.A. CD (mm-g/$mm^2$) | 0.625 | 0.628 | 0.639 | 0.623 |
| T.E.A. MD (mm-g/$mm^2$) | 2.094 | 2.062 | 2.049 | 2.074 |
| CD Break Modulus (g/%) | 90.54 | 103.85 | 103.20 | 100.59 |
| MD Break Modulus (g/%) | 32.55 | 31.23 | 34.12 | 31.90 |

The results of the trials shown in TABLES 5-9 demonstrate that Fabric 42 can be used to produce basesheets having an outstanding combination of properties, particularly caliper and absorbency. Without being bound by theory, we believe that these results stem, in part, from the configuration of knuckles and pockets in Fabric 42. Specifically, the configuration of Fabric 42 provides for a highly efficient creping operation due to the aspect ratio of the pockets (i.e., the length of the pockets in the MD versus the width of the pockets in the CD), the pockets being deep, and the pockets being formed in long, near continuous lines in the MD. These properties of the pockets allow for great fiber "mobility," which is a condition where the wet compressed web is subjected to mechanical forces that create localized basis weight movement. Moreover, during the creping process, the cellulose fibers in the web are subjected to various localized forces (e.g., pushed, pulled, bent, delaminated), and subsequently become more separated from each other. In other words, the fibers become de-bonded and result in a lower modulus for the product. The web therefore has better vacuum "moldability," which leads to greater caliper and a more open structure that provides for greater absorption.

Figure 15:
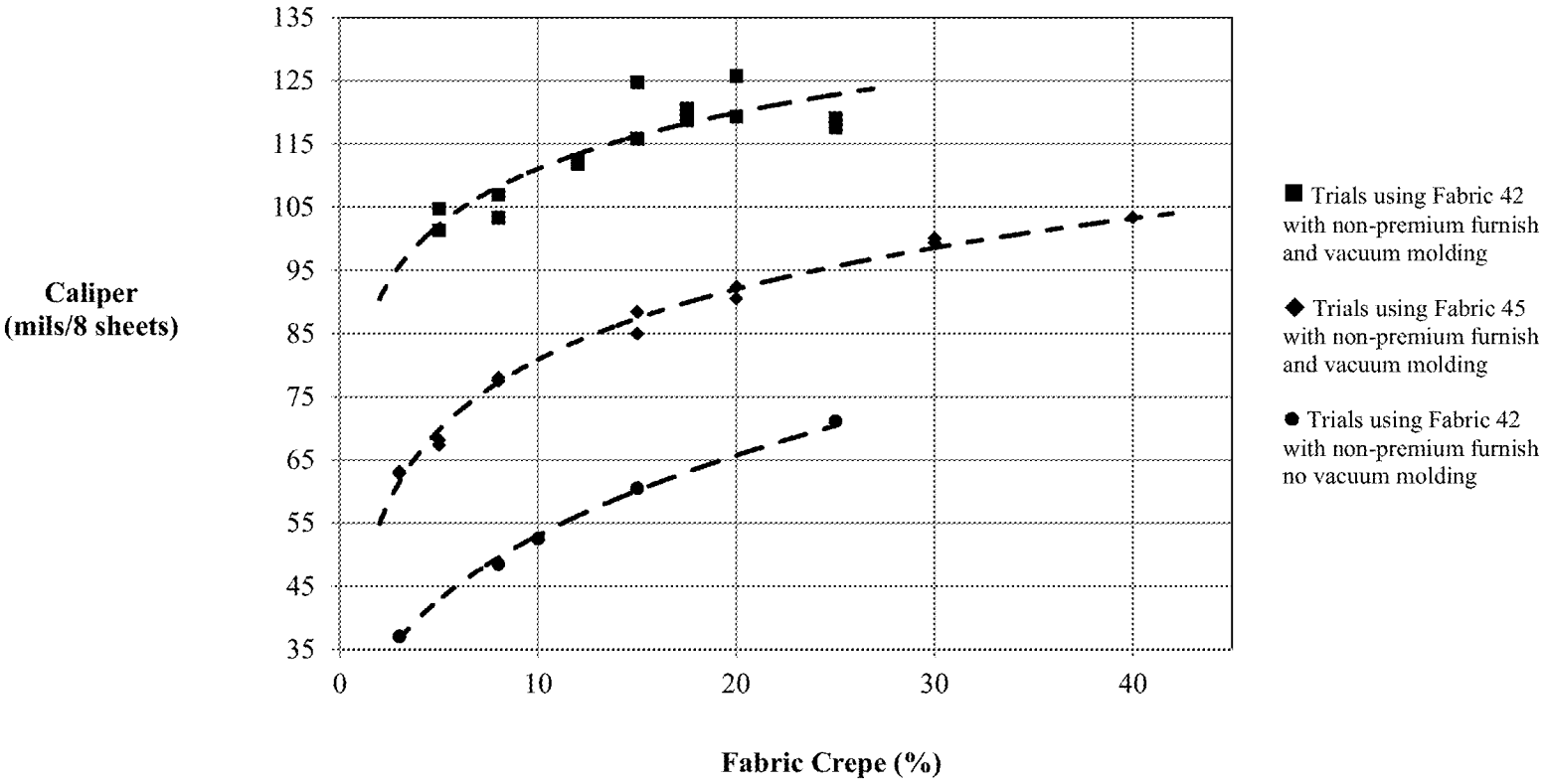
FIG. 15 is a chart showing fabric crepe percentage versus caliper for basesheets made with a fabric according to an embodiment of our invention and a comparative fabric.
Figure 16:
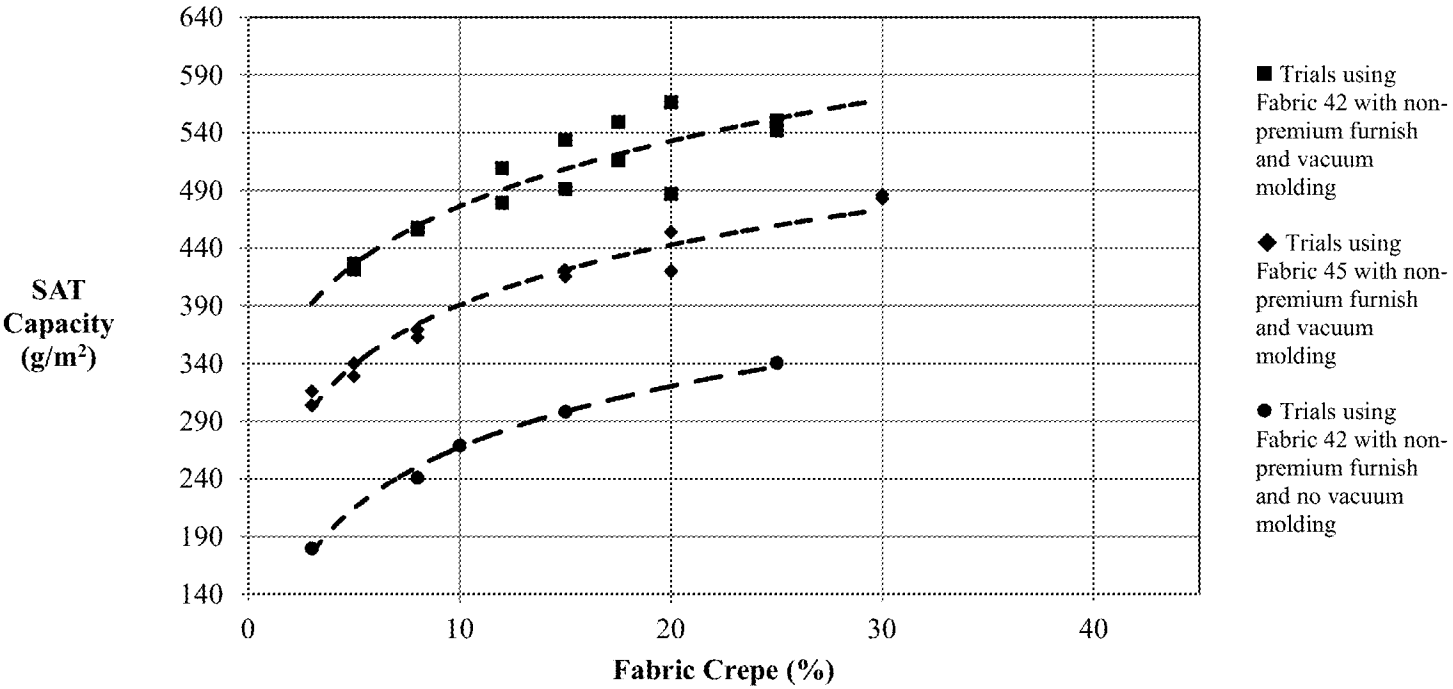
FIG. 16 is a chart showing fabric crepe percentage versus SAT capacity for basesheets made with a fabric according to an embodiment of our invention and a comparative fabric.

The fiber mobility provided for with the pocket configuration of Fabric 42 can be seen in the results shown in FIGS. 15 and 16. These figures compare the caliper, SAT capacity, and void volume at the various crepe levels used in the trials. FIGS. 15 and 16 show that, even in the trials with Fabric 42 where no vacuum molding was used, the caliper and SAT capacity increased with the increasing fabric crepe level. As there was no vacuum molding, it follows that these increases in caliper and SAT capacity are directly related to fiber mobility in Fabric 42. FIGS. 15 and 16 also demonstrate that a high amount of caliper and SAT capacity are achieved using Fabric 42—in the trials where vacuum molding is used, at each creping level the caliper and SAT capacity of the basesheets made with Fabric 42 were much greater than the caliper and SAT capacity of the basesheets made with Fabric 45.

The fiber moldability provided by Fabric 42 can also be seen in the results shown in FIGS. 15 and 16. Specifically, the differences between the caliper and SAT capacity in the trials with no vacuum molding and the trials with vacuum molding demonstrates that the fibers in the web are highly moldable on Fabric 42. As will be discussed below, vacuum molding draws out the fibers in the regions of the web formed in the pockets of Fiber 42.

The large fiber moldability means that the fibers are highly drawn out in this molding operation, which leads to the increased caliper and SAT capacity in the resulting product.

Figure 19:
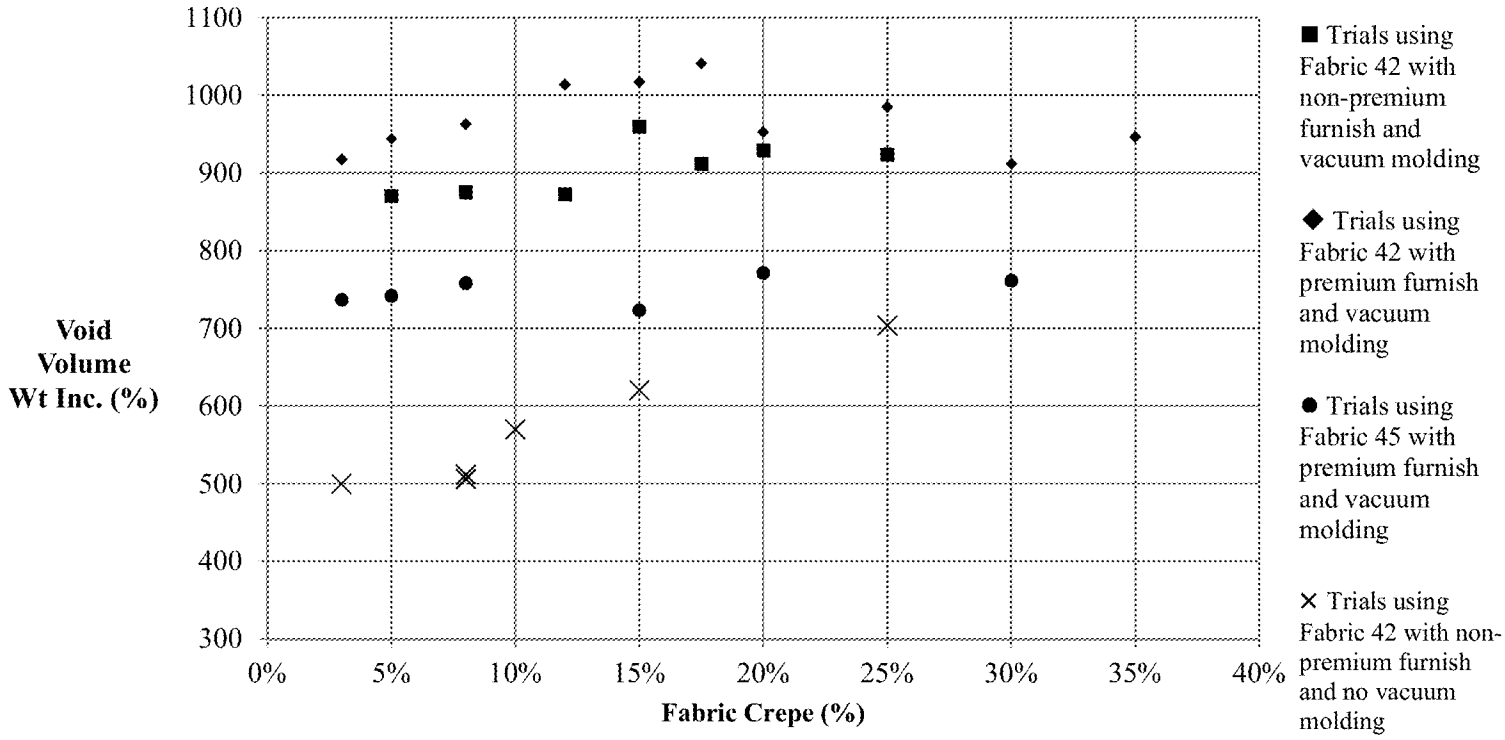
FIG. 19 is a chart showing fabric crepe percentage versus void volume for basesheets made with a fabric according to an embodiment of our invention and a comparative fabric.

FIG. 19 also evidences that greater fiber mobility is achieved with Fabric 42 by comparing the void volume of the basesheets from the trials at the fabric crepe levels. The absorbency of a sheet is directly related to void volume, which is essentially a measure of the space between the cellulose fibers. Void volume is measured by the procedure set forth in the aforementioned U.S. Pat. No. 7,399,378. As shown in FIG. 19, the void volume increased with the increasing fabric crepe in the trials using Fabric 42 where no vacuum molding was used. This indicates that the cellulose fibers were more separated from each other (i.e., de-bonded, with a lower resulting modulus) at each fabric crepe level in order to produce the additional void volume. FIG. 19 further demonstrates that, when vacuum molding is used, Fabric 42 produces basesheets with more void volume than the conventional Fabric 45 at each fabric crepe level.

Figure 20A:
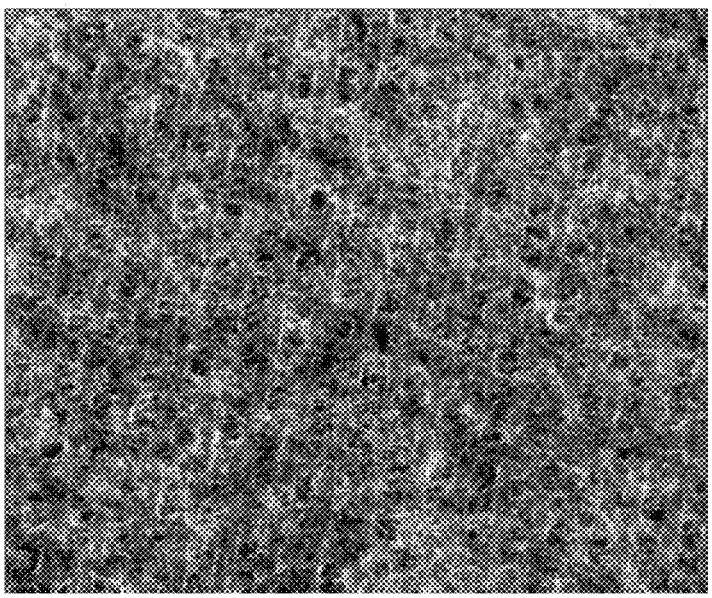
FIGS. 20(*a*) and 20(*b*) are soft x-ray images of an absorbent sheet according to an embodiment of our invention.
Figure 20B:
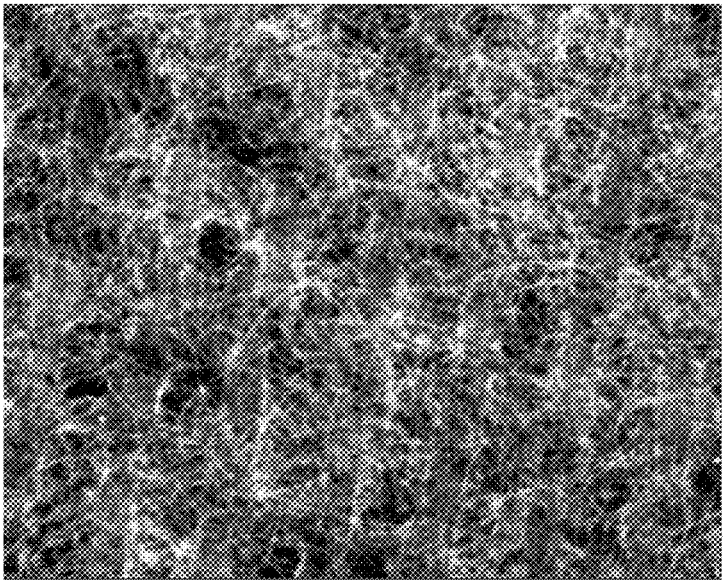
Figure 21A:
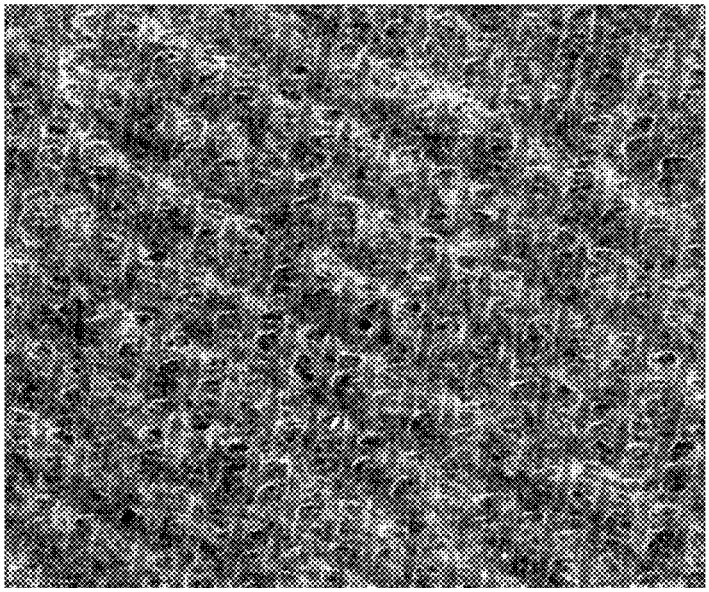
FIGS. 21(*a*) and 21(*b*) are soft x-ray images of an absorbent sheet according to another embodiment of our invention.
Figure 21B:
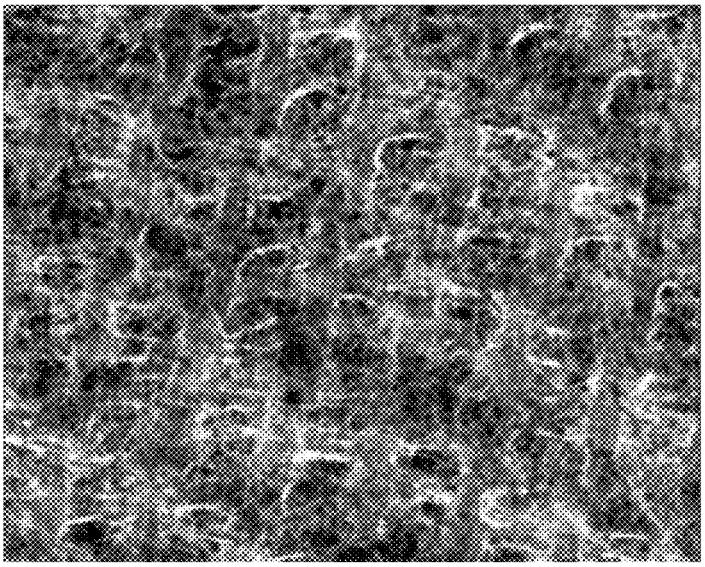
Figure 22A:
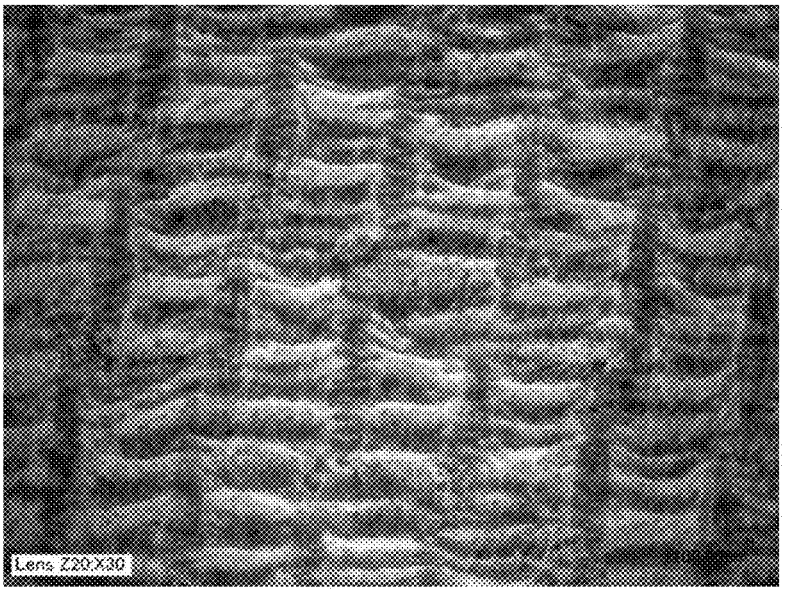
FIGS. 22(*a*)-22(*e*) are photographs of absorbent sheets according to further embodiments of our invention.
Figure 22B:
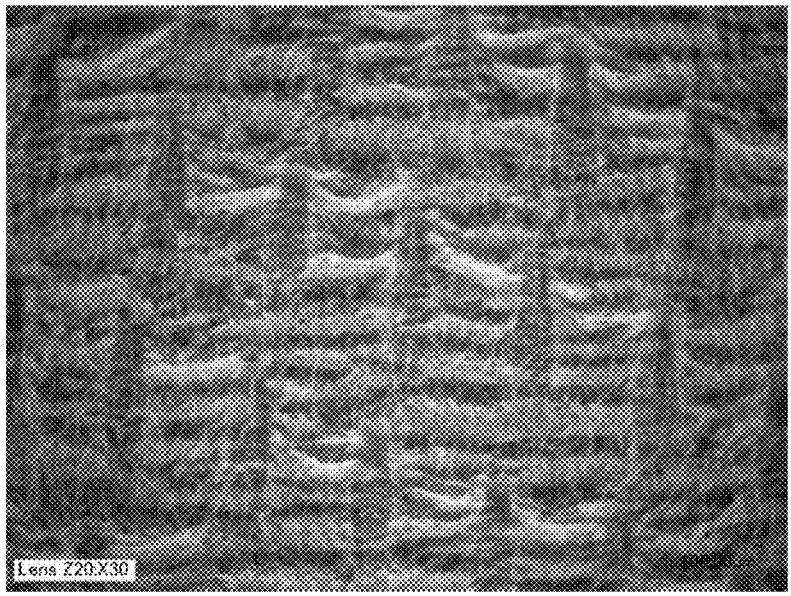
Figure 22C:
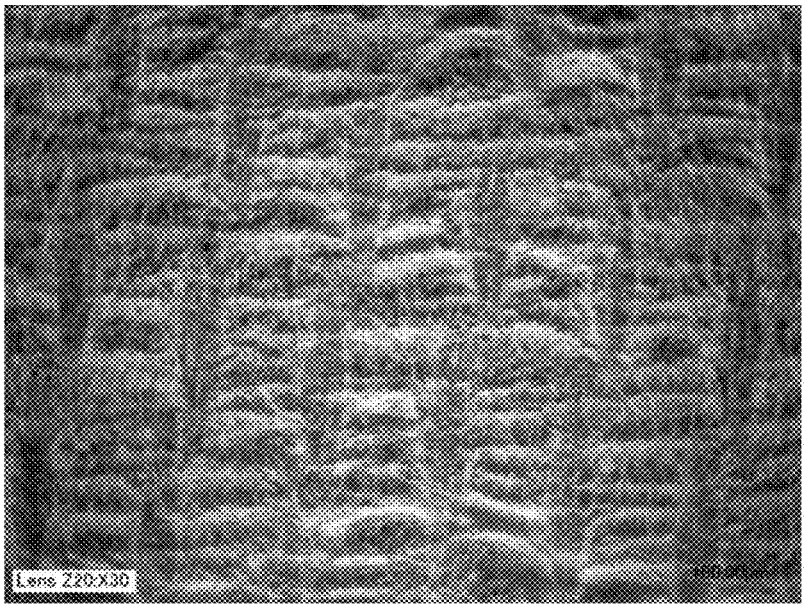
Figure 22D:
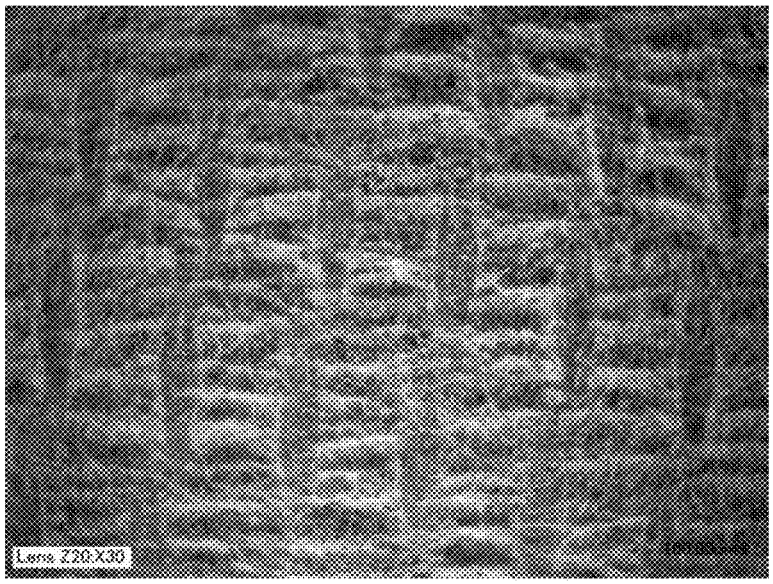
Figure 22E:
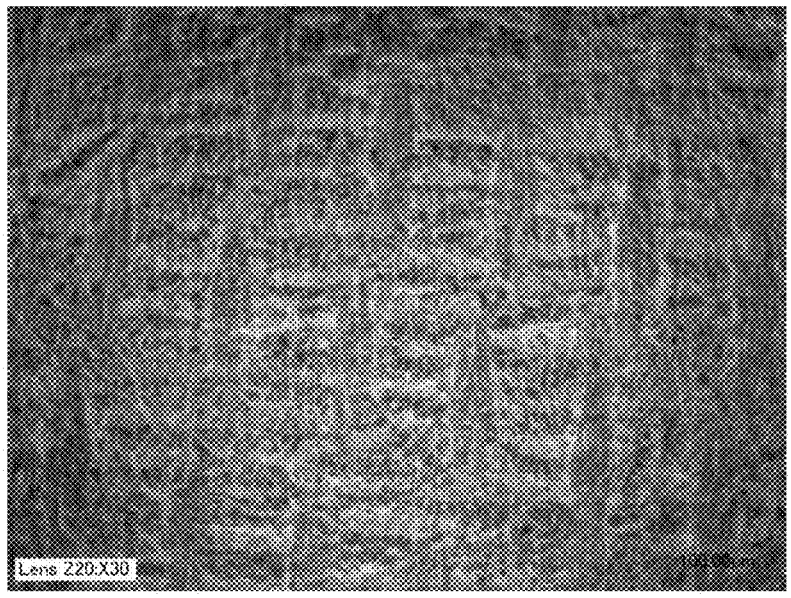

The fiber mobility when using Fabric 42 can also be seen in FIGS. 20(*a*), 20(*b*), 21(*a*), and 21(*b*), which are soft x-ray images of basesheets made using Fabric 42. As will be appreciated by those skilled in the art, soft x-ray imaging is a high-resolution technique that can be used for gauging mass uniformity in paper. The basesheets in FIGS. 20(*a*) and 20(*b*) where made with an 8 percent fabric crepe, whereas the basesheets in FIGS. 21(*a*) and 21(*b*) were made with a 25 percent fabric crepe. FIGS. 20(*a*) and 21(*a*) show fiber movement at a more "macro" level, with the images showing an area of 26.5 mm by 21.2 mm. Wave-like patterns of less mass (corresponding to the lighter regions in the images) can be seen with the higher fabric crepe (FIG. 21(*a*)), but regions of less mass are not readily seen with the lower fabric crepe (FIG. 20(*a*)). FIGS. 20(*b*) and 21(*b*) show the fiber movement at a more "micro" level, with the images showing an area of 13.2 mm by 10.6 mm. The cellulose fibers can clearly be seen as more distanced from each other and pulled apart with the higher fabric crepe (FIG. 21(*b*)) than with the lower fiber crepe (FIG. 20(*b*)). Collectively, the soft x-ray images further confirm that Fabric 42 provides for great fiber mobility with the higher localized mass movement being seen at the higher fabric crepe level than at the lower fabric crepe level.

Figure 17:
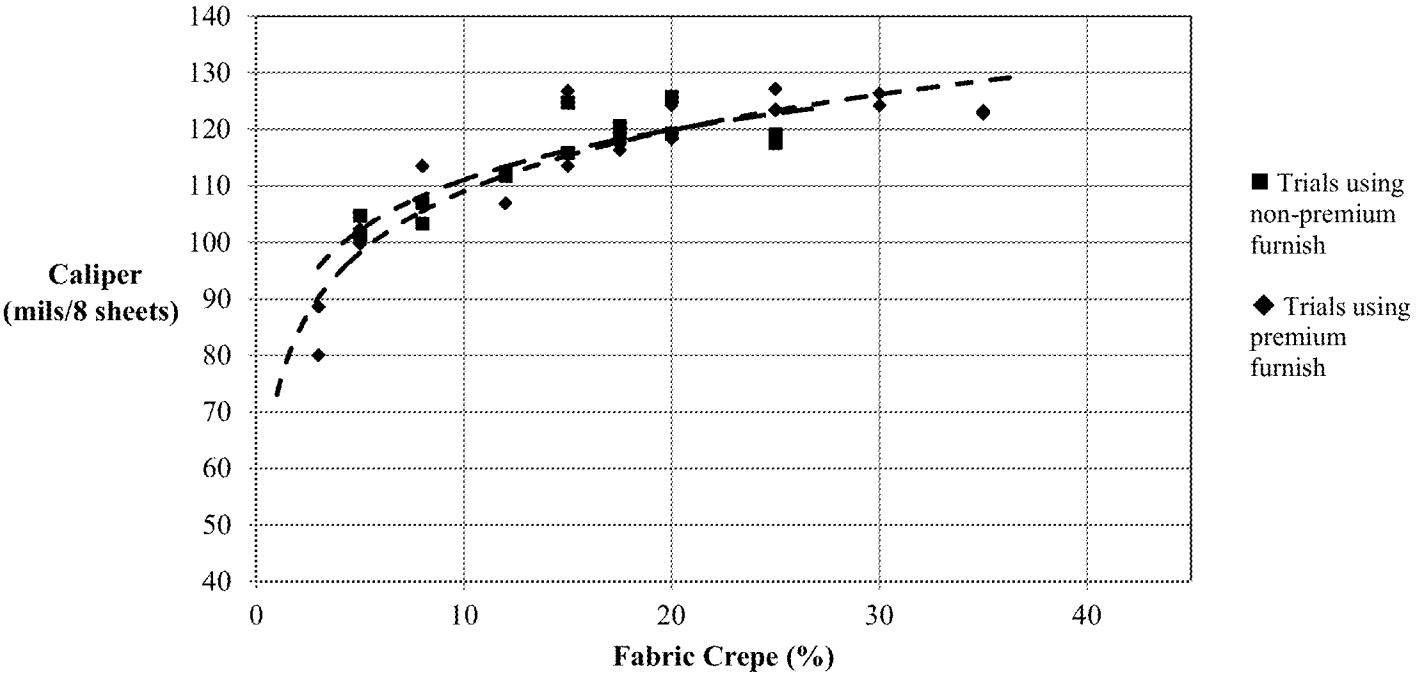
FIG. 17 is a chart showing fabric crepe percentage versus caliper for basesheets made with different furnishes and a fabric according to an embodiment of our invention.
Figure 18:
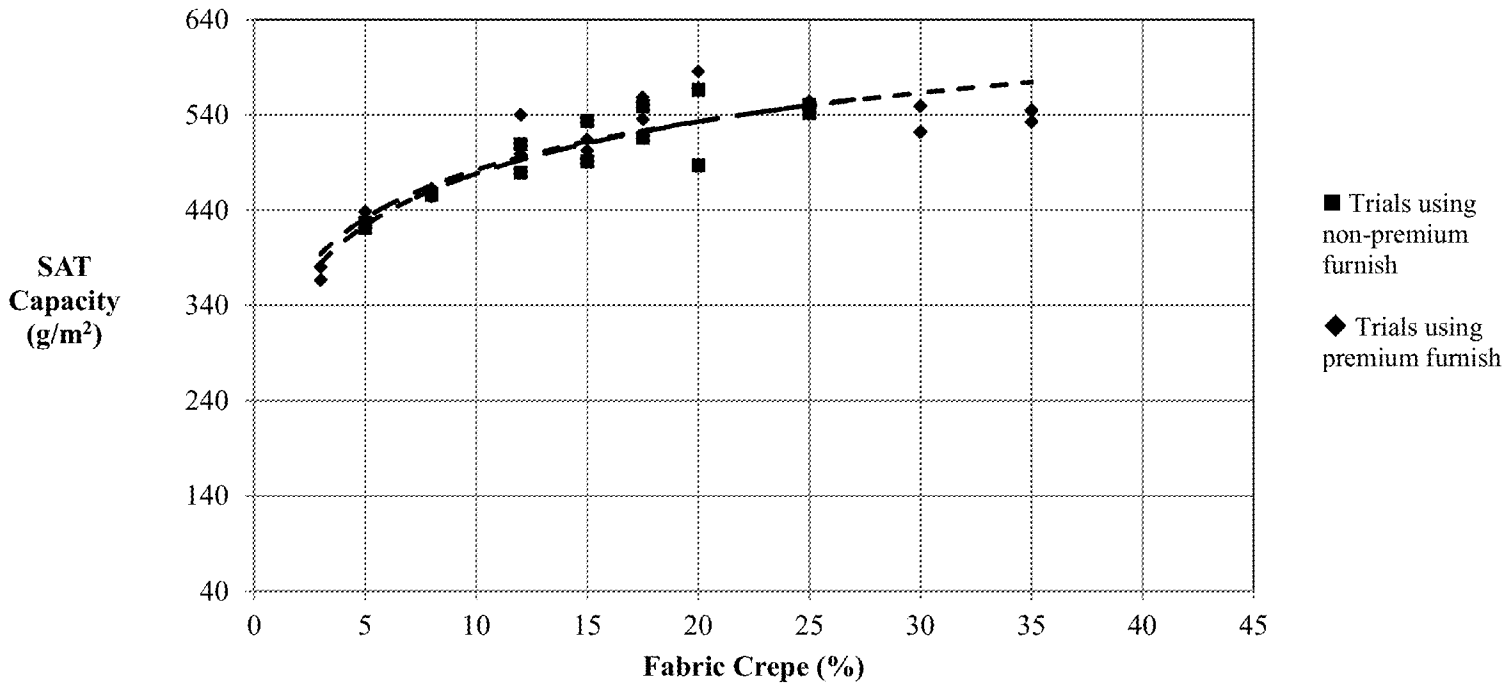
FIG. 18 is a chart showing fabric crepe percentage versus SAT capacity for basesheets made with different furnishes and a fabric according to an embodiment of our invention.

FIGS. 17 and 18, and also FIG. 19, show the results of the trials in terms of the furnish. Specifically, these figures show that Fabric 42 can produce comparable amounts of caliper, SAT capacity, and void volume when using the non-premium furnish as with the premium furnish. This is a very beneficial result as it demonstrates that the Fabric 42 can achieve outstanding results with a lower cost, non-premium furnish.

Because Fabric 42 has extra-long warp yarn knuckles, as with the other extra-long warp yarn knuckle fabrics described above, the products made with Fabric 42 may have multiple indented bars extending in a CD direction. The indented bars are again the result of folds being created in the areas of the web that are moved into the pockets of the structuring fabric. In the case of Fabric 42, it is believed that the aspect ratio of the length of the knuckles and the length across the pocket even further enhances the formation of the folds/indented bars. This is because the web is semi-restrained on the long warp knuckles while being more mobile within the pockets of Fabric 42. The result that the web can buckle or fold at multiple places along each pocket, which in turn leads to the CD indented bars seen in the products.

The indented bars formed in absorbent sheets made from Fabric 42 can be seen in FIGS. 22(*a*) through 22(*e*). These figures are images of the air-side of products made with Fabric 42 at different fabric creping levels but with no vacuum molding. The MD is in the vertical direction in all of these figures. Notably, instead of having sharply defined dome regions like the products described above, the products in FIGS. 22(*a*) through 22(*e*) are characterized by having parallel and near-continuous lines of projected regions substantially extending in the MD, with each of the extended projected regions including a plurality of indented bars extending across the projected regions in a substantially CD of the absorbent sheet. These projected rejections correspond to lines of pockets extending in the MD of Fabric 42. Between the projected regions are connecting regions that also extend substantially in the MD. The connecting regions correspond to the long warp yarn knuckles of Fabric 42.

The product in FIG. 22(*a*) was made with a fabric crepe of 25%. In this product, the indented bars are very distinct. It is believed that this pattern of indented bars are the result of the fiber network on Fabric 42 experiencing a wide range of forces during the creping process, including in-plane compression, tension, bending, and buckling. All of these forces will contribute to the fiber mobility and fiber moldability, as discussed above. And, as a result of the near continuous nature of the projected regions extending in the MD, the enhanced fiber mobility and fiber moldability can take place in a near continuous manner along the MD.

FIGS. 22(*b*) through 22(*e*) show the configuration of products with less fabric creping as compared to the product shown in FIG. 22(*a*). In FIG. 22(*b*), the fabric crepe level used to form the depicted product was 15%, in FIG. 22(*c*) the fabric crepe level was 10%, in FIG. 22(*d*) the fabric crepe level was 8%, and in FIG. 22(*e*) the fabric crepe level was 3%. As would be expected, the amplitude of the folds/indented bars can be seen to decrease with the decreasing fabric crepe level. However, it is notable that the frequency of the indented bars remains about the same through the fabric crepe levels. This indicates that the web is buckling/folding in the same locations relative to the knuckles and pockets in Fabric 42 regardless of fabric crepe level being used. Thus, beneficial properties stemming from the formation of folds/indented bars can be found even at lower fabric crepe levels.

In sum, FIGS. 22(*a*) through 22(*e*) show that the high pocket aspect ratio of Fabric 42 has the ability to uniformly exert decompacting energy to the web such that fiber mobility and fiber moldability are promoted over a wide fabric creping range. And, this fiber mobility and fiber moldability is a very significant factor in the outstanding properties, such as caliper and SAT capacity, found in the absorbent sheets made with Fabric 42.

Figure 23A:
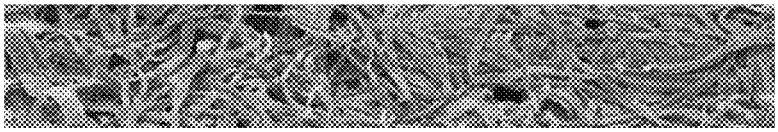
FIGS. 23(*a*) and 23(*b*) are photographs of an absorbent sheet according to an embodiment of our invention and a comparison absorbent sheet.
Figure 23B:
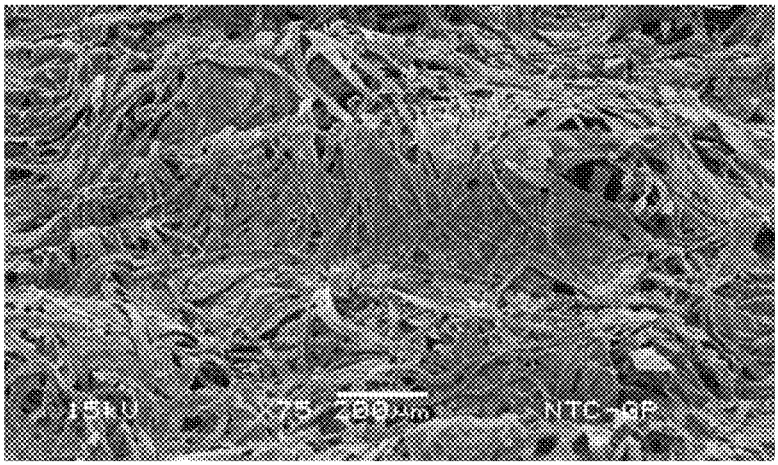
Figure 24A:
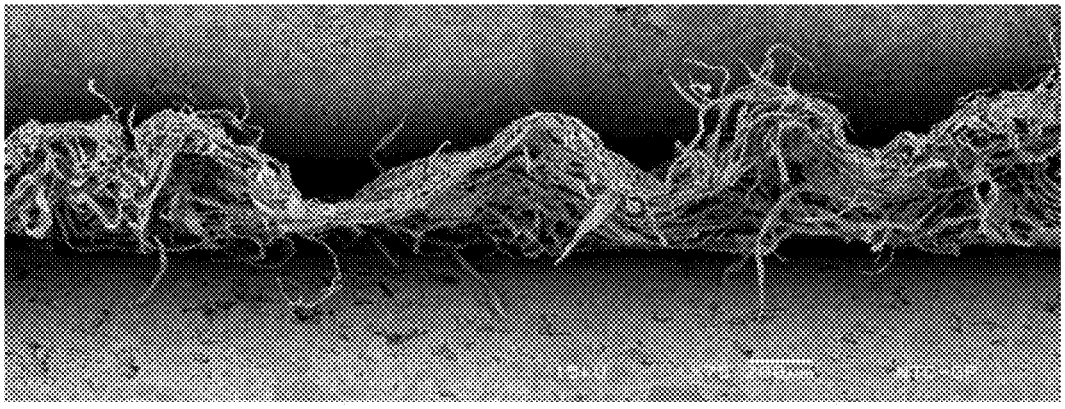
FIGS. 24(*a*) and 24(*b*) are photographs of cross sections of the absorbent sheets shown in FIGS. 23(*a*) and 23(*b*).
Figure 24B:
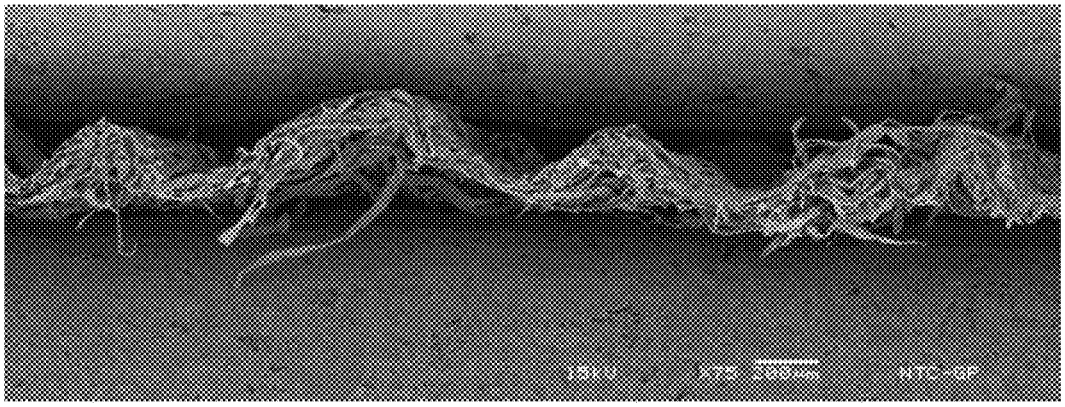

FIGS. 23(*a*) through 24(*b*) are scanning electron microscopy images of the air sides of a product made with Fabric 42 (FIGS. 23(*a*) and 24(*a*)) and a comparison product made with Fabric 45 (FIGS. 23(*b*) and 24(*b*)). In these cases, the products were made with 30% fabric crepe and maximum vacuum molding. The center regions of the images in FIGS. 23(*a*) and 23(*b*) show areas made in the pockets of the respective fabrics, with areas surrounding the center regions corresponding to regions formed on knuckles of the respective fabrics. The cross sections shown in FIGS. 24(*a*) and 24(*b*) extend substantially along the MD, with an extended projected region of the Fabric 42 product being seen in FIG. 24(*a*) and with multiple domes (as formed in multiple pockets) being seen in the Fabric 45 product shown in FIG. 24(*b*). It can very clearly be seen that the fibers in the product made with Fabric 42 are much less densely packed than the cellulose fibers in the product made with Fabric 45. That is, the center dome regions in the Fabric 45 product are highly dense—as dense, if not more dense, than the connecting region surrounding the pocket region in the Fabric 42 product. Moreover, FIGS. 24(*a*) and 24(*b*) show the fibers to be much looser, i.e., less dense, in the Fabric 42 product than in the Fabric 45 product, with distinct fibers springing out from the Fabric 42 product structure in FIG. 24(*a*). FIGS. 23(*a*) through 24(*b*) thereby further confirm that that Fabric 42 provides for a large amount of fiber mobility and fiber moldability creping process, which in turn results in regions of significantly reduced density in the absorbent sheet products made with the fabric. The reduced density regions provide for greater absorbency in the products. Further, the reduced density regions provide for more caliper as the sheet becomes more "puffed out" in the reduced density regions. Still further, the puffy, less dense regions will result in the product feeling softer to the touch.

Further trials were conducted using Fabric 42 to evaluate properties of converted towel products according to embodiments of our invention. For these trials, the same conditions were used as in the trials described in conjunction with TABLES 4 and 5. The basesheets were then converted to two-ply paper towel. TABLE 10 shows the converting specifications for these trials. Properties of products made in these trials are shown in TABLES 11-13.

TABLE 10

| Conversion Process | Gluing |
|---|---|
| Number of Plies | 2 |
| Roll Diameter | Varying |
| Sheet Count | 60 |
| Sheet Length | 10.4 |
| Sheet Width | 11 in. |
| Roll Compression | 6-12% |
| Emboss Process | Following process of U.S. Pat. No. 6,827,819 with the embossing pattern shown in U.S. Pat. Design No. D504,236 (which is incorporated by reference in its entirety) |
| Emboss Pattern | Constant/Non-Varying |

TABLE 11

| | Trial | | | | | | | | | |
|---|---|---|---|---|---|---|---|---|---|---|
| | 1 | 2 | 3 | 4 | 5 | 6 | 7 | 8 | 9 | 10 |
| Fabric | 42 | 42 | 42 | 42 | 42 | 42 | 42 | 42 | 42 | 42 |
| Fabric Crepe (%) | 3 | 5 | 8 | 12 | 15 | 17.5 | 20 | 25 | 30 | 35 |
| Furnish | P | P | P | P | P | P | P | P | P | P |
| Basis Weight (lbs/ream) | 31.57 | 31.39 | 31.27 | 31.12 | 31.21 | 30.94 | 31.34 | 31.69 | 31.50 | 29.99 |
| Caliper (mils/8 sheets) | 152.9 | 183.1 | 185.9 | 204.1 | 215.2 | 218.7 | 225.2 | 236.0 | 229.9 | 223.3 |
| MD Tensile (g/3 in) | 3,296 | 2,716 | 2,786 | 2,651 | 2,454 | 2,662 | 2,624 | 2,405 | 2,553 | 2,363 |
| CD Tensile (g/3 in) | 2,656 | 2,479 | 2,503 | 2,526 | 2,420 | 2,617 | 2,668 | 2,478 | 2,279 | 2182 |
| GM Tensile (g/3 in) | 2,958 | 2,595 | 2,641 | 2,588 | 2,437 | 2,639 | 2,646 | 2,441 | 2,412 | 2271 |
| Tensile Ratio | 1.24 | 1.10 | 1.11 | 1.05 | 1.01 | 1.02 | 0.98 | 0.97 | 1.12 | 1.08 |
| MD Stretch (%) | 8.7 | 11.0 | 13.5 | 17.3 | 20.3 | 22.6 | 25.2 | 28.5 | 32.3 | 32.2 |
| CD Stretch (%) | 6.1 | 7.0 | 7.7 | 8.3 | 9.0 | 9.0 | 9.4 | 10.1 | 10.6 | 10.7 |
| CD Wet Tensile - Finch (g/3 in) | 797 | 724 | 738 | 747 | 746 | 788 | 803 | 729 | 728 | 707 |
| CD Wet/Dry - Finch (%) | 30.0 | 29.2 | 29.5 | 29.6 | 30.8 | 30.1 | 30.1 | 29.4 | 31.9 | 32.4 |
| Perf Tensile (g/3") | 608 | 534 | 577 | 572 | 562 | 601 | 560 | 495 | 616 | 514 |
| SAT Capacity (g/m$^2$) | 344 | 404 | 385 | 416 | 450 | 465 | 479 | 530 | 527 | 520 |
| SAT Capacity (g/g) | 6.7 | 7.9 | 7.6 | 8.2 | 8.9 | 9.2 | 9.4 | 10.3 | 10.3 | 10.6 |
| SAT Rate (g/sec$^{0.5}$) | 0.09 | 0.15 | 0.10 | 0.12 | 0.14 | 0.15 | 0.15 | 0.18 | 0.17 | 0.19 |
| GM Break Modulus (g/%) | 407.2 | 295.3 | 257.7 | 216.5 | 180.4 | 183.4 | 172.7 | 144.8 | 130.0 | 122.8 |
| Roll Diameter (in) | 4.57 | 4.93 | 5.01 | 5.03 | 5.07 | 5.08 | 5.15 | 5.35 | 5.12 | 5.14 |
| Roll Compression (%) | 12.1 | 11.56 | 12.38 | 10.06 | 7.89 | 7.81 | 6.93 | 8.78 | 6.90 | 7.52 |
| Sensory Softness | N/C | 10.1 | 9.7 | N/C | N/C | N/C | 9.0 | 9.2 | N/C | N/C |

TABLE 12

| | Trial | | | | | | | | | |
|---|---|---|---|---|---|---|---|---|---|---|
| | 11 | 12 | 14 | 15 | 16 | 17 | 18 | 19 | 20 | 21 |
| Fabric | 42 | 42 | 42 | 42 | 42 | 42 | 42 | 42 | 42 | 42 |
| Fabric Crepe (%) | 35 | 5 | 8 | 12 | 15 | 17.5 | 20 | 25 | 20 | 25 |
| Furnish | P | NP | NP | NP | NP | NP | NP | NP | NP | NP |
| Basis Weight (lbs/ream) | 29.99 | 31.41 | 31.67 | 31.09 | 31.61 | 31.34 | 31.60 | 31.85 | 31.43 | 31.26 |
| Caliper (mils/8 sheets) | 223.3 | 175.6 | 183.0 | 197.8 | 213.4 | 212.3 | 220.6 | 220.3 | 200.3 | 208.2 |
| MD Tensile (g/3 in) | 2,363 | 2,878 | 2,885 | 2,481 | 2,447 | 2,385 | 2,397 | 2374 | 2,684 | 2424 |
| CD Tensile (g/3 in) | 2182 | 2,495 | 2,621 | 2,523 | 2,563 | 2,615 | 2,523 | 2341 | 2,545 | 2591 |
| GM Tensile (g/3 in) | 2271 | 2,680 | 2,750 | 2,502 | 2,505 | 2,497 | 2,460 | 2357 | 2,613 | 2506 |
| Tensile Ratio | 1.08 | 1.15 | 1.10 | 0.98 | 0.95 | 0.91 | 0.95 | 1.01 | 1.05 | 0.94 |
| MD Stretch (%) | 32.2 | 10.1 | 12.9 | 16.9 | 19.0 | 20.5 | 23.0 | 28.5 | 23.8 | 27.4 |
| CD Stretch (%) | 10.7 | 7.2 | 7.6 | 8.2 | 8.1 | 8.6 | 8.8 | 9.6 | 8.5 | 8.4 |
| CD Wet Tensile - Finch (g/3 in) | 707 | 767 | 828 | 825 | 752 | 758 | 752 | 770 | 865 | 738 |
| CD Wet/Dry - Finch (%) | 32.4 | 30.7 | 31.6 | 32.7 | 29.3 | 29.0 | 29.8 | 32.9 | 34.0 | 28.5 |
| Perf Tensile (g/3 in) | 514 | 644 | 668 | 575 | 586 | 496 | 580 | 602 | 614 | 530 |
| SAT Capacity (g/m$^2$) | 520 | 362 | 402 | 430 | 497 | 490 | 520 | 514 | 473 | 499 |
| SAT Capacity (g/g) | 10.6 | 7.1 | 7.8 | 8.5 | 9.7 | 9.6 | 10.1 | 9.9 | 9.2 | 9.8 |
| SAT Rate (g/sec$^{0.5}$) | 0.19 | 0.11 | 0.14 | 0.14 | 0.22 | 0.23 | 0.22 | 0.20 | 0.19 | 0.24 |
| GM Break Modulus (g/%) | 122.8 | 313.3 | 278.5 | 211.4 | 201.2 | 188.2 | 171.6 | 144.0 | 182.3 | 164.6 |
| Roll Diameter (in) | 5.14 | 4.79 | 4.84 | 4.89 | 5.13 | 5.05 | 5.31 | 5.10 | 5.03 | 5.01 |

TABLE 12-continued

| | Trial | | | | | | | | | |
|---|---|---|---|---|---|---|---|---|---|---|
| | 11 | 12 | 14 | 15 | 16 | 17 | 18 | 19 | 20 | 21 |
| Roll Compression (%) | 7.52 | 8.70 | 9.02 | 7.08 | 9.48 | 7.52 | 11.74 | 6.86 | 10.14 | 7.71 |
| Sensory Softness | N/C | 9.4 | N/C | N/C | 9.2 | N/C | 9.2 | 9.1 | N/C | 8.8 |

TABLE 13

| | Trial | | | | | | |
|---|---|---|---|---|---|---|---|
| | 22 | 23 | 24 | 25 | 265 | 27 | 28 |
| Fabric | 42 | 45 | 45 | 45 | 45 | 45 | 45 |
| Fabric Crepe (%) | 25 | 3 | 5 | 8 | 15 | 20 | 30 |
| Furnish | NP | NP | NP | NP | NP | NP | NP |
| Basis Weight (lbs/ream) | 26.22 | 31.20 | 31.53 | 30.83 | 31.11 | 31.24 | 30.98 |
| Caliper (mils/8 sheets) | 120.3 | 130.5 | 137.3 | 159.3 | 164.1 | 172.5 | 182.3 |
| MD Tensile (g/3 in) | 2687 | 2,939 | 2,742 | 2,787 | 2,647 | 2,649 | 2,629 |
| CD Tensile (g/3 in) | 2518 | 2,569 | 2,510 | 2,664 | 2,726 | 2,647 | 2,594 |
| GM Tensile (g/3 in) | 2601 | 2,748 | 2,623 | 2,724 | 2,686 | 2,648 | 2,611 |
| Tensile Ratio | 1.07 | 1.14 | 1.09 | 1.05 | 0.97 | 1.00 | 1.01 |
| MD Stretch (%) | 30.0 | 8.4 | 9.3 | 18.7 | 18.1 | 21.7 | 31.1 |
| CD Stretch (%) | 7.9 | 5.1 | 5.0 | 6.3 | 6.4 | 7.0 | 7.7 |
| CD Wet Tensile - Finch (g/3 in) | 793 | 732 | 767 | 764 | 756 | 766 | 789 |
| CD Wet/Dry - Finch (%) | 31.5 | 28.5 | 30.5 | 28.7 | 27.7 | 28.9 | 30.4 |
| Perf Tensile (g/3 in) | 613 | 621 | 528 | 593 | 637 | 591 | 570 |
| SAT Capacity (g/m$^2$) | 215 | 298 | 314 | 384 | 386 | 406 | 404 |
| SAT Capacity (g/g) | 5.0 | 5.9 | 6.1 | 7.7 | 7.6 | 8.0 | 8.0 |
| SAT Rate (g/sec$^{0.5}$) | 0.04 | 0.10 | 0.10 | 0.14 | 0.14 | 0.15 | 0.14 |
| GM Break Modulus (g/%) | 168.2 | 422.4 | 385.5 | 276.5 | 249.2 | 213.6 | 166.6 |
| Roll Diameter (in) | 5.24 | 4.35 | 4.36 | 4.44 | 4.54 | 4.61 | 4.55 |
| Roll Compression (%) | 6.16 | 14.5 | 13.9 | 10.0 | 9.1 | 8.4 | 5.2 |
| Sensory Softness | N/C | N/C | 9.3 | N/C | N/C | 8.7 | 8.4 |

Note that Trial 22 only formed a one-ply product, but was otherwise converted in the same manner as the other trials.

The results shown in TABLES 11-13 demonstrate the excellent properties that can be achieved using a long warp warn knuckle fabric according to our invention. For example, the final products made with Fabric 42 had higher caliper and higher SAT capacity than the comparison products made with Fabric 45. Further, the results in TABLES 11-13 demonstrate that very comparable products can be made with Fabric 42 regardless of whether a premium or a non-premium furnish is used.

Based on properties of the products made in the trials described herein, it is clear that the long warp yarn knuckle structuring fabrics described herein can be used in methods that provide products having outstanding combinations of properties. For example, the long warp yarn knuckle structuring fabrics described herein can be used in conjunction with the non-TAD process described generally above and specifically set forth in the aforementioned '563 patent, (wherein the papermaking furnish is compactively dewatered before creping) to form an absorbent sheet that has SAT capacities of at least about 9.5 g/g and at least about 500 g/m2. Further, this absorbent sheet can be formed in the method while using a creping ratio of less than about 25%. Even further, the method and long warp yarn knuckle structuring fabrics can be used to produce an absorbent sheet that has SAT capacities of at least about at least about 10.0 g/g and at least about 500 g/m2, has a basis weight of less than about 30 lbs/ream, and a caliper 220 mils/8 sheets. We believe that this type of method has never created such an absorbent sheet before.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

The invention can be used to produce desirable paper products such as hand towels or toilet paper. Thus, the invention is applicable to the paper products industry.

We claim:

1. An absorbent cellulosic sheet that has a first side and a second side, the absorbent sheet comprising:

(a) a plurality of domed regions projecting from the first side of the sheet, wherein each domed region is positioned adjacent to another domed region such that a staggered line of domed regions extends substantially along the machine direction (MD) of the absorbent sheet; and (b) connecting regions forming a network interconnecting the domed regions of the absorbent sheet, wherein each connecting region is substantially continuous with two other connecting regions such that substantially continuous lines of connecting regions extend in a stepped manner along the MD of the absorbent sheet.

2. The absorbent sheet according to claim 1, wherein each of the domed regions includes a plurality of indented bars extending across the domed regions in the cross machine direction (CD) of the absorbent sheet.

3. The absorbent sheet according to claim 2, wherein at least some of the domed regions includes eight indented bars.

4. The absorbent sheet according to claim 1, wherein each of the domed regions extends a distance of about 2.5 mm to about 3.0 mm in the MD of the absorbent sheet.

5. The absorbent sheet according to claim 1, wherein the domed regions are rectangular-shaped.

6. An absorbent cellulosic sheet that has a first side and a second side, the absorbent sheet comprising:

(a) a plurality of domed regions projecting from the first side of the sheet, wherein each of the domed regions extends (i) a distance of at least 2.5 mm in the machine direction (MD) of the absorbent sheet, and (ii) includes an indented bar extending across the domed region in a substantially cross machine direction (CD) of the absorbent sheet, and wherein the indented bar extends a depth of at least about 45 microns below adjacent portions of the domed region; and (b) connecting regions forming a network interconnecting the domed regions of the absorbent sheet.

7. The absorbent sheet according to claim 6, wherein each of the domed regions includes a plurality of indented bars.

8. The absorbent sheet according to claim 6, wherein the indented bars extend a depth of about 90 microns below the adjacent portions of the domed regions.

9. The absorbent sheet according to claim 6, wherein the domed regions extend a distance of about 1.0 mm in the CD of the absorbent sheet.

10. The absorbent sheet according to claim 6, wherein each of the domed regions extends at least about 2.5 mm to about 5.5 mm in the MD of the absorbent sheet.

11. The absorbent sheet according to claim 6, wherein the indented bar extends a depth of about 45 microns to about 160 microns below adjacent portions of the domed region.

12. An absorbent sheet according to claim 6, wherein each domed region is positioned adjacent to another domed region such that staggered lines of domed regions extend substantially along the MD of the absorbent sheet, and wherein each connecting region is substantially continuous with two other connecting regions, such that substantially continuous lines of connecting regions extend in a stepped manner along the MD of the absorbent sheet.

13. The absorbent sheet according to claim 12, wherein connecting regions extending in the MD of the absorbent sheet extend a distance of about 0.5 mm in the CD of the absorbent sheet.

14. An absorbent cellulosic sheet that has a first side and a second side, the absorbent sheet comprising:

(a) projected regions extending from the first side of the sheet, the projected regions extending substantially in the machine direction (MD) of the absorbent sheet, each of the projected regions including a plurality of indented bars extending across the projected regions in a substantially cross machine direction (CD) of the absorbent sheet, and the projected regions being substantially parallel to each other; and (b) connecting regions between the projected regions, the connecting regions extending substantially in the MD.

15. The absorbent sheet according to claim 14, wherein the sheet is a single-ply sheet having a basis weight of less than about 27 lbs/ream and a caliper of less than about 180 mils/8 sheets.

16. The absorbent sheet according to claim 14, wherein the sheet is a multi-ply sheet having a basis weight of greater than about 35 lbs/ream and a caliper of greater than about 225 mils/8 sheets.

* * * * *